US006318918B1

(12) United States Patent
Sasaki et al.

(10) Patent No.: US 6,318,918 B1
(45) Date of Patent: Nov. 20, 2001

(54) RECORDING SHEET PACKAGE FOR USE WITH PRINTER, AND RECORDING SHEET SUPPLYING METHOD

(75) Inventors: Hidemi Sasaki; Shusuke Mogi, both of Saitama; Yoshio Ishizuka, Kanagawa, all of (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/253,032

(22) Filed: Feb. 19, 1999

(30) Foreign Application Priority Data

Mar. 10, 1998 (JP) ..... 10-058195
Mar. 10, 1998 (JP) ..... 10-058196
Mar. 10, 1998 (JP) ..... 10-058197
Mar. 26, 1998 (JP) ..... 10-079690

(51) Int. Cl.[7] ..... B41J 11/58
(52) U.S. Cl. ..... 400/624; 271/145
(58) Field of Search ..... 400/624, 625, 400/629, 642; 53/410, 412, 492, 128.1, 537, 255; 271/145, 167

(56) References Cited

U.S. PATENT DOCUMENTS 4,698,646 * 10/1987 Satoh et al. ..... 400/624
4,853,713 * 8/1989 Piatt et al. ..... 400/629
5,137,269 8/1992 Yamamoto ..... 271/145
5,138,344 * 8/1992 Ujita ..... 400/175
5,296,874 * 3/1994 Nagata et al. ..... 400/624

FOREIGN PATENT DOCUMENTS 0 768 566 A2 4/1997 (EP) .
5-116774 5/1993 (JP) .
401294074A * 11/1989 (JP) ..... 400/624
402081660A * 3/1990 (JP) ..... 400/624

OTHER PUBLICATIONS

"Edge Force Sheet Separating System" Xerox Disclosure Journal, vol. 8, No. 4. p 315–316, Jul./Aug. 1983.*
Japanese Abstract No. 09101596 dated Apr. 15, 1997.
Japanese Abstract No. 62004141 dated Jan. 10, 1987.
Japanese Abstract No. 60097145 dated May 30, 1985.

* cited by examiner

*Primary Examiner*—Eugene Eickholt
(74) *Attorney, Agent, or Firm*—Sughrue, Mion, Zinn, Macpeak & Seas, PLLC

(57) ABSTRACT

A thermal printer is loaded with a recording sheet package. The recording sheet package has a packaging body, which contains a stack of plural recording sheets. A loading engaging cutout is formed in the packaging body, and when the packaging body is set in an acceptable orientation relative to the printer, is engaged with a loading guiding projection of the printer, and allows mounting the packaging body on the printer. When the packaging body is set in an orientation different from the acceptable orientation, the loading guiding projection inhibits the packaging body by interference from being mounted on the printer.

26 Claims, 24 Drawing Sheets

RECORDING SHEET PACKAGE FOR USE WITH PRINTER, AND RECORDING SHEET SUPPLYING METHOD

BACKGROUND OF THE INVENTION

1. Field of the Invention

The present invention relates to a recording sheet package for use with a printer, and a recording sheet supplying method. More particularly, the present invention relates to a recording sheet package for use with a printer in which positioning of stacked recording sheets is stabilized, and a recording sheet supplying method.

2. Description Related to the Prior Art

There are two types of thermal printer, including a direct thermal printing type and a thermal transfer type, for each of which recording sheet of a predetermined type is used. The recording sheet for the direct thermal printing is constituted by a support and three thermosensitive coloring layers overlaid thereon, which are cyan, magenta and yellow coloring layers. Heat energy of three values is applied to the recording sheet to develop colors of each of the coloring layers. Each coloring layer after being heated is optically fixed prior to thermal recording of a succeeding one of the coloring layers. For this optical fixation, ultraviolet rays of a predetermined range of the wavelength are applied to the recording sheet to destroy the coloring ability of each coloring layer. The succeeding coloring layer can be safely heated without influencing the density of the color developed in the preceding coloring layer. If the recording sheet of the direct thermal printing type is kept subjected to light from lamps as widely used appliances for light source, the coloring ability of the recording sheet is remarkably influenced. Consequently a stack of recording sheets is contained in a light-tight packaging bag, and furthermore contained in a cardboard box to be shipped commercially.

There are two types of thermal transfer printer, including a wax-transfer type and a sublimation type. The wax-transfer printer melts or softens ink of ink film, and transfers it to the recording sheet. The sublimation printer sublimates or disperses dye of ink film on to the recording sheet. The recording sheet for the wax-transfer printer consists of coat paper having high smoothness. The recording sheet for the sublimation printer consists of paper coated with polyester resin. For both of the thermal transfer printers, a plurality of recording sheets are stacked and contained in a moisture proof bag, which is then contained in a cardboard box to be shipped for sale.

A recording sheet package is used for easy handling of a stack of the recording sheets. To load the printer with the recording sheets, at first a packaging bag is opened to remove the recording sheet package, which is inserted in a sheet supply cassette. The sheet supply cassette is set in the printer. So the loading of the recording sheets is complicated to most of the users. While a user manually removes the recording sheets from the packaging bag, it is likely that the recording sheets are exposed to ambient light and touched by the user's hand. In the case of the recording sheets for the thermal transfer printing, touched portions are discolored by fingerprints. In the case of the recording sheets for the direct thermal printing, the coloring ability of the uppermost one of the recording sheets is influenced by the ambient light.

JP-A 5-116774 discloses the recording sheet package in which the recording sheets are not touched directly by user's hand, and with which the printer can be easily loaded with the recording sheets. A cutting line with a train of perforations is formed in a body of the recording sheet package. A portion of the body of the recording sheet package is cut away by tearing the cutting line, to form an opening for removal of the recording sheets. The tearing requires a user's manual operation prior to the loading into the printer.

It is likely that a user erroneously orients the recording sheet package to be inserted in the sheet supply cassette or in a printer, with the upper side of the recording sheet package directed downwards or with the front side directed backwards. When the upper side of the recording sheet package is directed downwards, printing heat is applied to the back surface reverse to the recording surface. No image is obtained in an acceptable manner, to waste the recording sheets. Particularly in the printer of the direct thermal printing, heating of the back surface causes damages to an array of heating elements of a thermal head.

It is possible to detect errors in loading of the recording sheets if the printer is provided with a sensor for detecting a recording surface and a back surface of the recording sheets. However such a sensor considerably raises a manufacturing cost of the printer. The loading with an error must be finished before the error can be detected. Thus operation of removal of the sheet supply cassette prior to the reloading is inevitable, and lowers efficiency in the loading.

Relative to the inner surface of a packaging body of the recording sheet package, the recording sheets become free in the course of a decrease of the remainder of the recording sheets. Curling tendency may occur in the recording sheets. If the packaging body containing the remainder of the recording sheets is removed from the sheet supply cassette, the recording sheets are likely to drop out of the packaging body to be damaged as the recording sheets are free.

A lifter lever opening is formed in a bottom wall of the recording sheet package according to the prior art in addition to a roller inserting opening for the supply roller. A lifter lever raises the recording sheets through the lifter lever opening to press the uppermost one of the recording sheets against the supply roller. The existence of the lifter lever opening is likely to cause entry of dust, ambient light or moisture into the recording sheet package after removal from the sheet supply cassette. Thus a problem is caused by the lifter lever opening in the low performance in shielding light and moisture.

The stack of the recording sheets are tightly contacted by the packaging body while contained in it. It is difficult in manufacturing the recording sheet package to use a method of inserting the recording sheets into the packaging body. It is general to manufacture the recording sheet package by wrapping the recording sheets with a packaging. The tight contact of the packaging body with the recording sheets causes high resistance to the advance of the recording sheets, to lower the smoothness in the supply of the recording sheets. Should the recording sheets be loosely contained in the packaging body with a space, the recording sheets are not positioned stably in the packaging body. Problems occur in the printing, as the recording sheets may advance obliquely or may be jammed.

SUMMARY OF THE INVENTION

In view of the foregoing problems, an object of the present invention is to provide a recording sheet package for use with a printer, capable of being mounted easily thereon, and a recording sheet supplying method.

Another object of the present invention is to provide a recording sheet package for use with a printer, which can be set in the printer simply without having a portion to be torn by manual operation, and a recording sheet supplying method.

A further object of the present invention is to provide a recording sheet package for use with a printer, in which errors in orientation relative to the printer can be prevented, and a recording sheet supplying method.

Another object of the present invention is to provide a recording sheet package for use with a printer, of which the orientation relative to the printer can be checked without such an expensive structure as a sensor, and a recording sheet supplying method.

Still another object of the present invention is to provide a recording sheet package for use with a printer, in which the recording sheets are prevented from dropping out of a packaging body, and a recording sheet supplying method.

Another object of the present invention is to provide a recording sheet package for use with a printer, which is free from having a lifter lever opening and can be protected from ambient light or moisture, and a recording sheet supplying method.

A further object of the present invention is to provide a recording sheet package for use with a printer, in which recording sheets can be advanced while positioned stably, and a recording sheet supplying method.

In order to achieve the above and other objects and advantages of this invention, a recording sheet package for use with a printer includes plural recording sheets. The recording sheet package has a packaging body, of which one end is open, and which contains a stack of plural recording sheets. A loading engaging portion is disposed on the packaging body, and when the packaging body is set in a predetermined acceptable orientation relative to the printer, engaged with a loading guiding member, for allowing mounting the packaging body on the printer, wherein when the packaging body is set in an orientation different from the acceptable orientation, the loading guiding member or the loading engaging portion inhibits the packaging body by interference from being mounted on the printer.

In a preferred embodiment, the loading engaging portion comprises at least one cutout, formed in a periphery of the packaging body, for receiving insertion of the loading guiding member.

Furthermore, a spacer is disposed in the packaging body and sideways from the recording sheets with reference to a supply direction of the recording sheets, for positioning the recording sheets sideways within the packaging body by defining a gap, wherein the loading engaging portion is constituted by the gap, and receives insertion of the loading guiding member.

The printer includes a cassette loading port. A sheet supply cassette is mounted in the cassette loading port. The loading guiding member projects from an inside of the sheet supply cassette. The recording sheet package is mounted in the sheet supply cassette.

In another preferred embodiment, the recording sheet package is mounted in a sheet loading port formed in the printer. The loading guiding member projects from an inside of the sheet loading port.

By this construction, errors in orientation of the recording sheet package relative to the printer can be prevented, because the loading guiding member or the loading engaging portion interferes if there is any error.

Also the orientation of the recording sheet package relative to the printer can be checked without such an expensive structure as a sensor, because the loading engaging portion can be reliably engaged with loading guiding member if accepted.

In addition, the recording sheets can be advanced while positioned stably, because the loading engaging portion or the loading guiding member guides an edge of the recording sheets.

In another aspect of the present invention, the packaging body includes a supply opening for passage of the recording sheets in a supply direction, to supply the printer therewith. An anti-dropping structure prevents the recording sheets from dropping out of the supply opening.

By this construction, the recording sheets are prevented from dropping out of the packaging body.

In a further aspect of the present invention, a packaging body is formed by bending one packaging sheet or plate, substantially having a thin box shape, for containing a stack of the recording sheets. The packaging body includes a supply opening for passage of the recording sheets in a supply direction, to supply the printer therewith. A bottom plate and a top plate are opposed to each other, and adapted to contain the stack of the recording sheets and to define the supply opening therebetween, the bottom plate being movable at the supply opening toward the top plate.

The packaging body further includes a push plate, disposed on the top plate to extend from the supply opening, for contacting a top face of the recording sheets, to push the recording sheets toward the bottom plate.

The printer includes a cassette loading port. A sheet supply cassette is mounted in the cassette loading port. A lifter mechanism is disposed in a bottom wall of the supply cassette. The recording sheet package is mounted in the supply cassette, the bottom plate is pushed by the lifter mechanism so as to press the recording sheets against the top plate.

Each periphery of the bottom plate and the top plate has first to fourth side lines, the supply opening is located on the first side line, the first and second side lines are opposed to each other, and the third and fourth side lines are opposed to each other. The packaging body further includes an end plate, disposed on the second side line, for extending to connect the bottom plate and the top plate with each other. First and second lateral plates are formed with the top plate, disposed on respective the third and fourth side lines, for extending toward the bottom plate, the first and second lateral plates being free from the bottom plate at least partially, to set the bottom plate movable.

Furthermore, first and second securing plates are disposed on respective side lines of the first and second lateral plates opposite to the top plate, and partially overlapped outside the bottom plate. An adhesive layer is applied partially to the first and second securing plates, for attaching the first and second securing plates to the bottom plate.

By this construction, the recording sheet package is capable of being mounted easily on the printer, because of the simple construction of the packaging body with the bottom and top plates.

Also the recording sheet package can be set in the printer simply without having a portion to be torn by manual operation.

In addition, the recording sheet package is free from having a lifter lever opening and can be protected from ambient light or moisture, because of the partially movable feature of the bottom plate.

In still another aspect of the present invention, a recording sheet package contains first to Nth recording sheets stacked upwards in sequence, and supplies a printer with the recording sheets. In the recording sheet package, a first packaging sheet packages the first recording sheet. Second to Nth packaging sheets includes a Kth packaging sheet for packaging a Kth one of the recording sheets with a (K−1)th one of the recording sheets and a (K−1)th one of the packaging sheets, wherein the (K−1)th packaging sheet becomes openable when the Kth packaging sheet is opened, so as to allow supplying the (K−1)th recording sheet after the Kth recording sheet is supplied.

By this construction, the recording sheet package is free from having a lifter lever opening and can be protected from ambient light or moisture, because only the first to Nth packaging sheets wrap the recording sheets.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1:
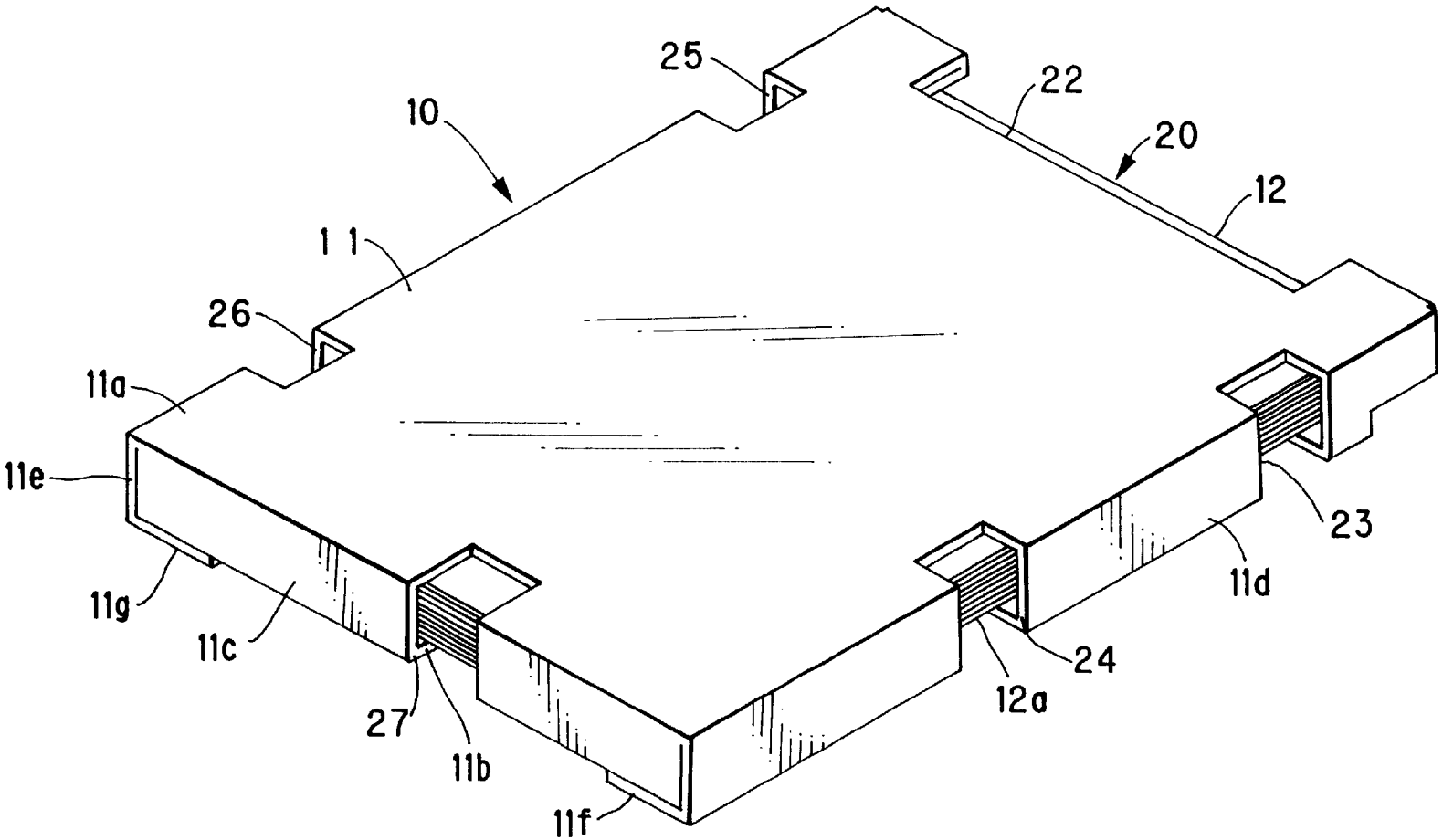
FIG. 1 is a perspective illustrating a recording sheet package.
Figure 2:
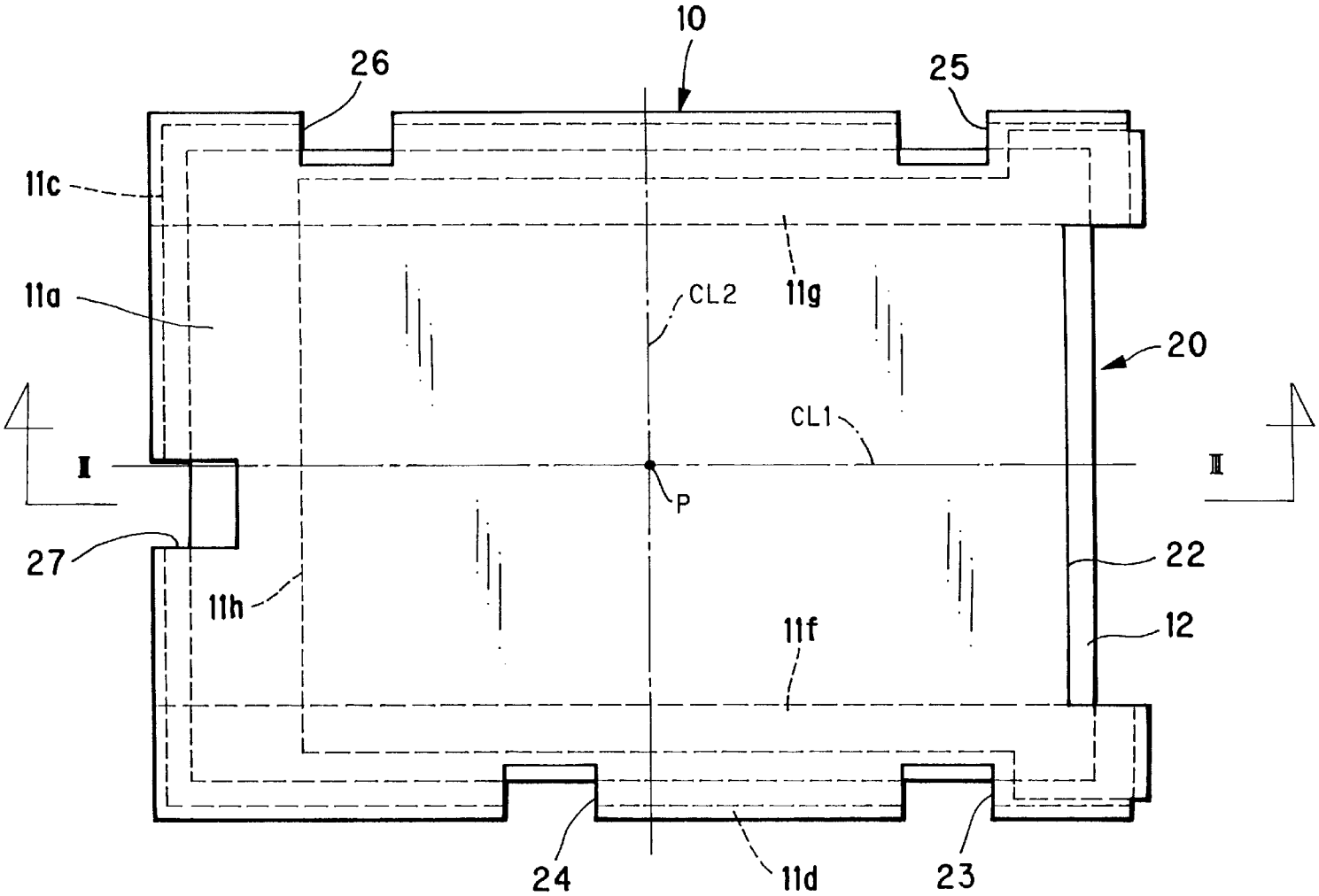
FIG. 2 is a plan illustrating the recording sheet package.

In FIGS. 1 and 2, a recording sheet package 10 has a packaging body 11, which is in a thin box shape, and produced from dust proof paper or cardboard with a great thickness and made of long fiber. The use of this type of paper is effective in avoiding creation of dust of paper in the course of cutting the paper or supply of a recording sheet. The printing is not influenced by the use of the packaging body 11 of the paper. Note that it is possible to constitute the packaging body 11 by use of a board of paper instead of the dust proof paper. Also plastics may be used to form the packaging body 11.

Figure 3:
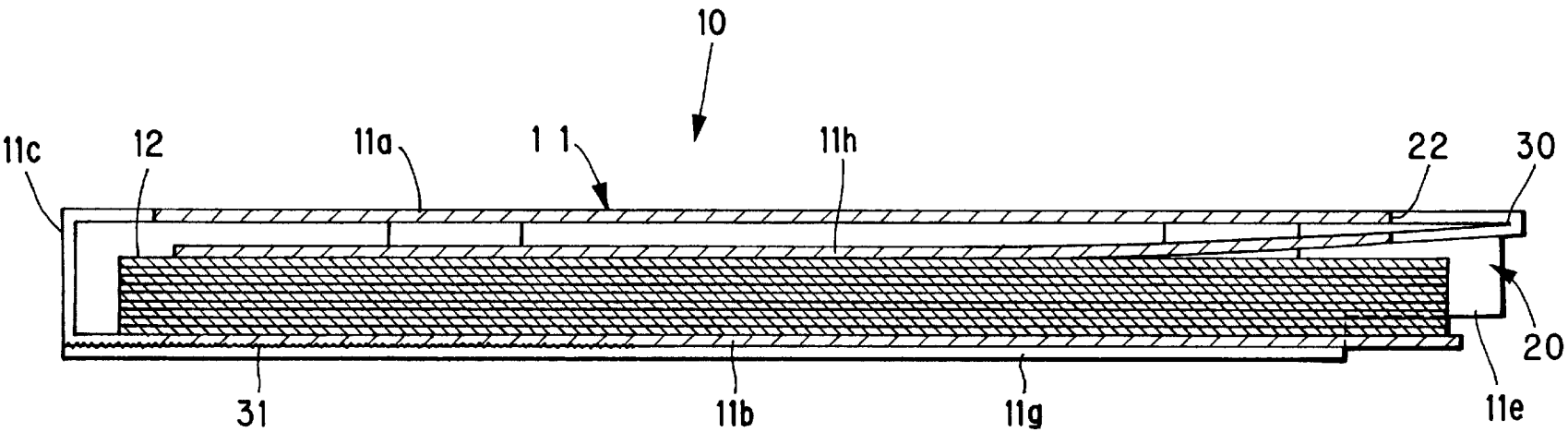
FIG. 3 is a vertical section illustrating the recording sheet package.

In FIG. 3, a stack of 20 thermosensitive recording sheets 12 of a direct thermal printing type is contained in the packaging body 11. The recording sheets 12 are contained in the packaging body 11 by directing their recording surface downwards and their back surface upwards. If the recording sheets 12 are thermal printing stickers having an adhesive layer, the recording sheets 12 have a greater thickness so that a stack of only ten (10) recording sheets 12 is contained in the packaging body 11. Of course the number of the recording sheets 12 to be contained can be changed suitably in consideration of the thickness of the recording sheets 12. A protective sheet may be additionally disposed under the lowest one of the recording sheets 12, and may have a size equal to that of the recording sheets 12.

Figure 4:
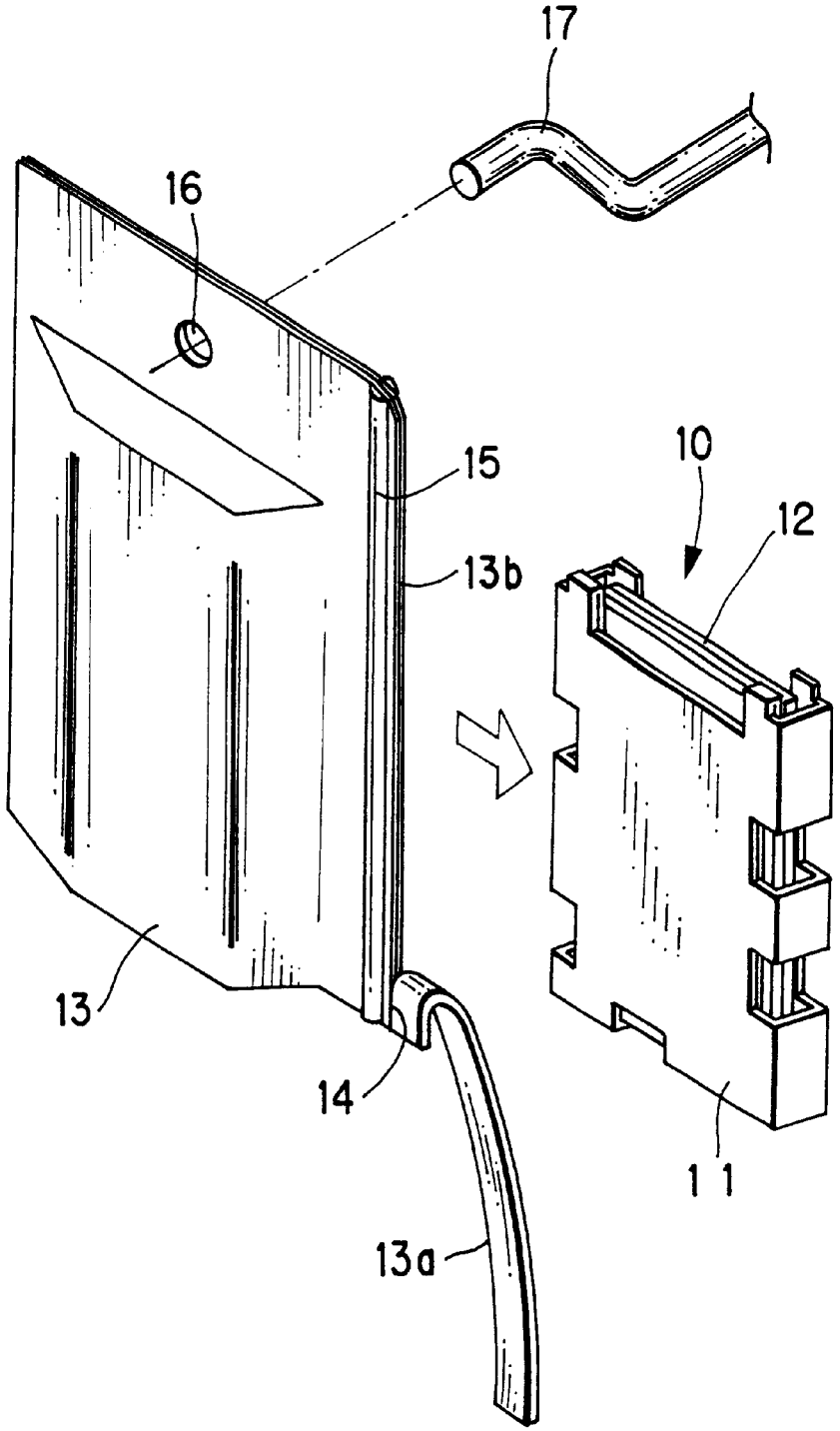
FIG. 4 is a perspective illustrating a state of removal of the recording sheet package from an outer packaging bag.

In FIG. 4, the recording sheet package 10 is contained in an outer packaging bag 13 having light-shielding and moisture proof characteristics. A hole 16 is formed in the top end of the outer packaging bag 13, for insertion of a suspension hook 17. When the recording sheet package 10 is displayed for retail sale, the outer packaging bag 13 with the recording sheet package 10 is suspended.

To use the recording sheets 12, a cut margin 13*a* of the outer packaging bag 13 is cut away along a cut line 14. A fastener 15 of synthetic resin is disposed in the vicinity of an open edge 13*b* of the outer packaging bag 13. The fastener 15 is well-known in the art, and consists of a combination of a groove-formed ridge and a ridge fitted therein. The outer packaging bag 13 is used again by opening and closing the fastener 15. If the recording sheet package 10 or the like is re-contained in the outer packaging bag 13 before the finish of being used, the fastener 15 is closed to enclose the recording sheet package 10.

Figure 5:
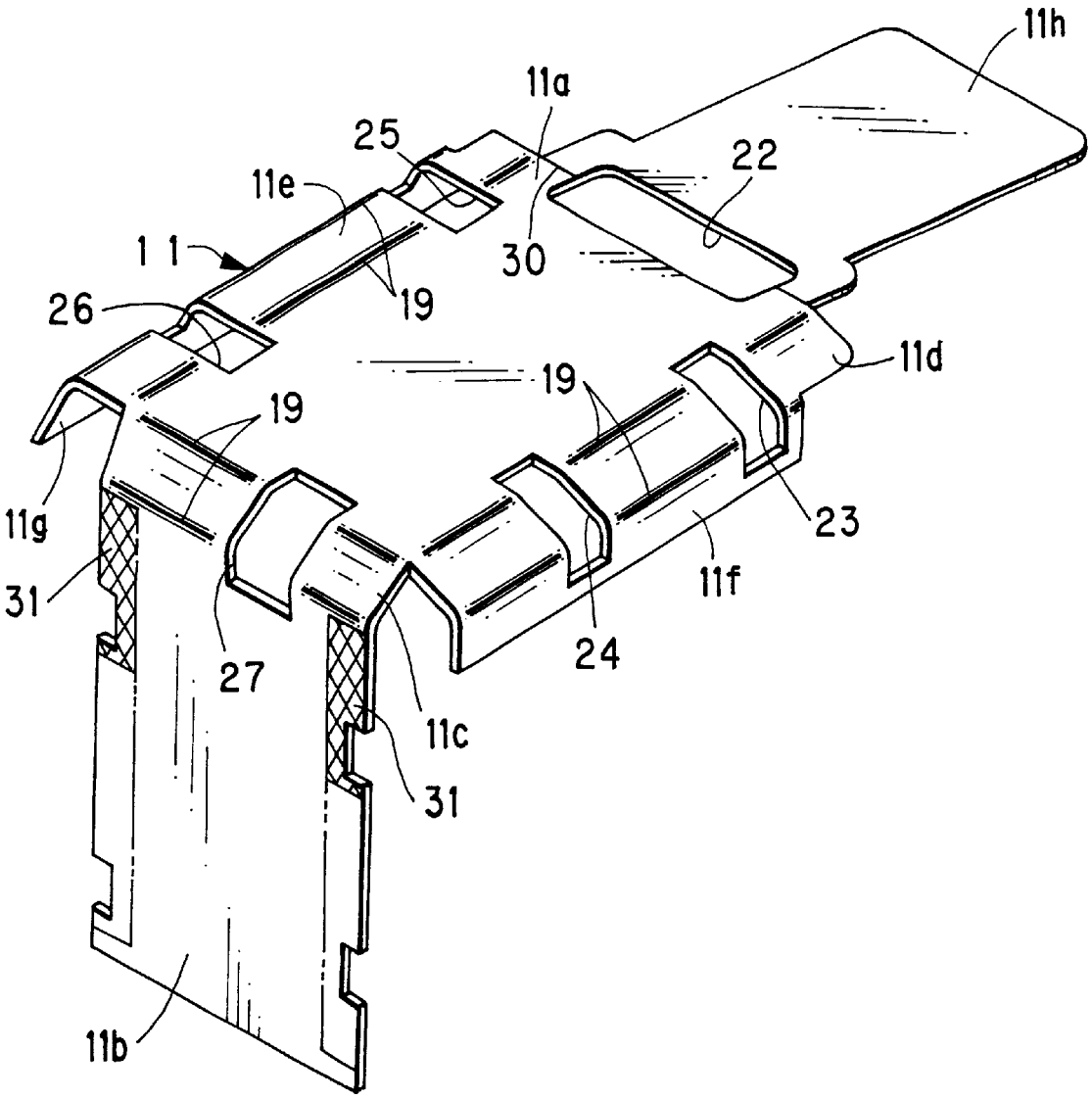
FIG. 5 is a perspective illustrating a spread state of the packaging body.

In FIGS. 1, 2 and 5, the packaging body 11 is constituted of one top plate 11*a*, one bottom plate 11*b*, one end plate 11*c* and two lateral plates 11*d* and 11*e*. The top and bottom plates 11*a* and 11*b* are rectangular and slightly larger than the recording sheets 12. The combination of the plates 11*a*–11*e* is bent by use of bend lines 19 in an erect manner to constitute the packaging body 11 in the thin box shape.

In FIG. 3, a supply opening 20 is formed in the packaging body 11 to lie in a shorter side line of the packaging body 11. A roller receiving recess 22 is formed in the packaging body 11 along an edge between the top plate 11*a* and a push plate 11*h* (See FIG. 5), communicates with the supply opening 20, and receives a supply roller 21 (See FIG. 9) of the thermal printer. The roller receiving recess 22 is defined by forming an opening in a spread sheet from which the packaging body 11 has been produced.

Loading engaging cutouts 23–27 are formed in the lateral plates 11*d* and 11*e* and the end plate 11*c*. The loading engaging cutouts 23–27 are defined by partially cutting the top and bottom plates 11*a* and 11*b* in addition to cutting of the lateral plates 11*d* and 11*e* and the end plate 11*c*.

Among the loading engaging cutouts 23–27 in FIG. 2, the loading engaging cutouts 24, 26 and 27 are formed in positions asymmetric with respect to a reference line CL1, which is directed in a supply direction of the recording sheets 12 and passes the center P of the packaging body 11. The loading engaging cutouts 23 and 24 are formed in positions asymmetric with respect to a reference line CL2, which is perpendicular to the supply direction of the recording sheets 12 and passes the center P of the packaging body 11.

In FIG. 5, a spread state of the packaging body 11 is illustrated. The lateral plates 11*d* and 11*e* are arranged connectively with the top plate 11*a* via the bend lines 19. Fixing plates 11*f* and 11*g* are arranged connectively with the lateral plates 11*d* and 11*e* via the bend lines 19. The end plate 11*c* communicates with a shorter side line of the top plate 11*a* opposite to the supply opening 20. Also the end plate 11*c* communicates with the bottom plate 11*b*. The push plate 11*h* communicates with a shorter side line of the top plate 11*a* at the supply opening 20 via a bend line 30.

An adhesive layer 31 is formed by applying adhesive agent to regions of the securing plates 11*f* and 11*g* in contact with the bottom plate 11*b* in the vicinity of the end opposite to the supply opening 20. The adhesive layer 31 keeps the packaging body 11 shaped like a box. The regions with the adhesive layer 31 are not the entire surface of the securing plates 11*f* and 11*g*. A length of those regions of the adhesive layer 31 is at least ⅓ as great as a length of the longer side line of the packaging body 11, and at most ½ as great as the same. The remainder of the securing plates 11*f* and 11*g* is not attached but free from the remaining portion of the bottom plate 11*b*, which operates like a movable flap.

In FIG. 3, the push plate 11*h* is bent at an angle of approximately 150 degrees via the bend line 30 to lie under the top plate 11*a*. The push plate 11*h* presses the recording sheets 12 against the bottom plate 11*b*, so as to keep the recording sheets 12 in tight contact with one another. No gap will be created between each two of the recording sheets 12. This is effective in protecting the recording surfaces from being influenced by moisture or ambient light, as the moisture and the light are shielded.

Figure 6:
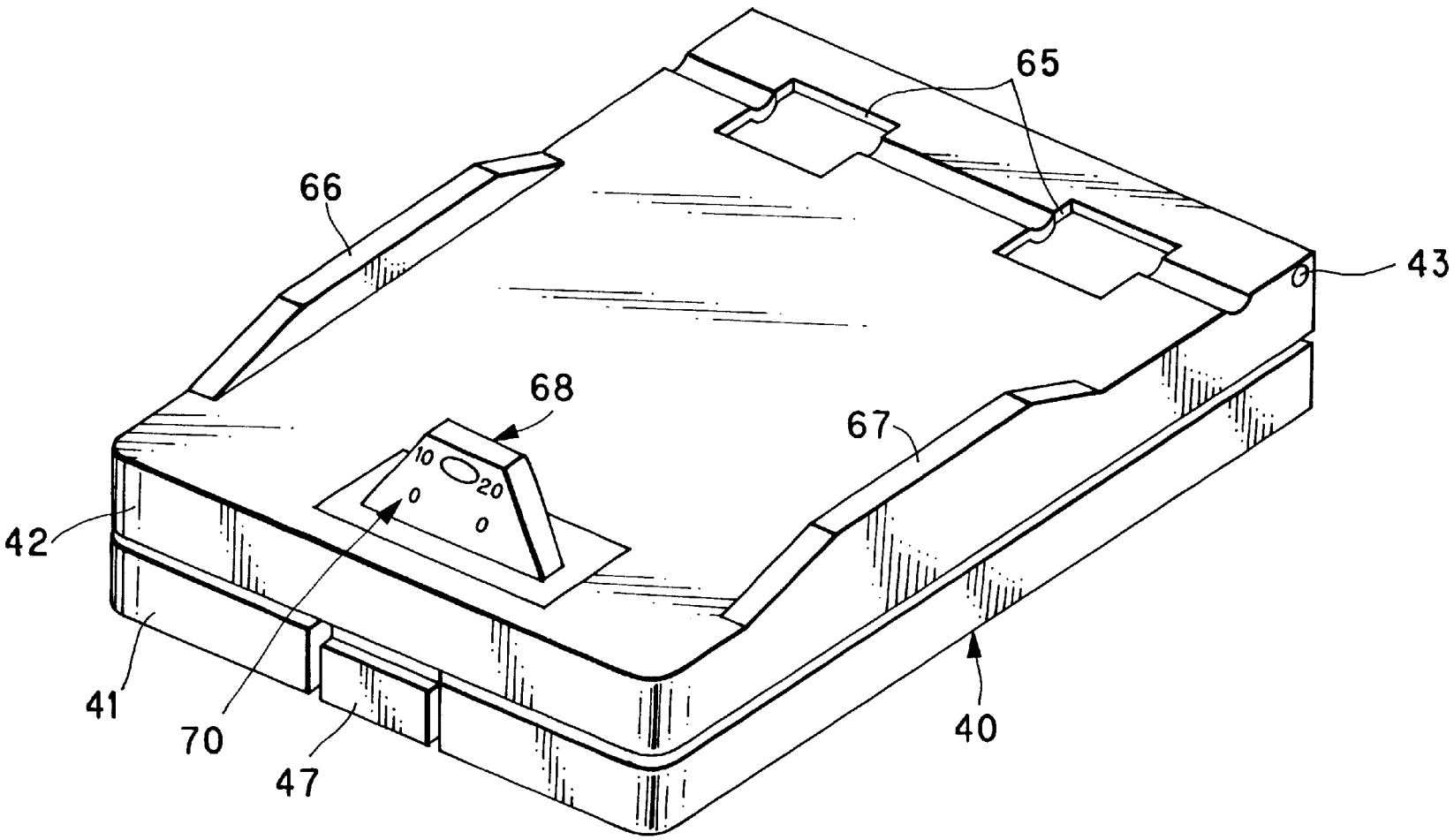
FIG. 6 is a perspective illustrating a sheet supply cassette.
Figure 7:
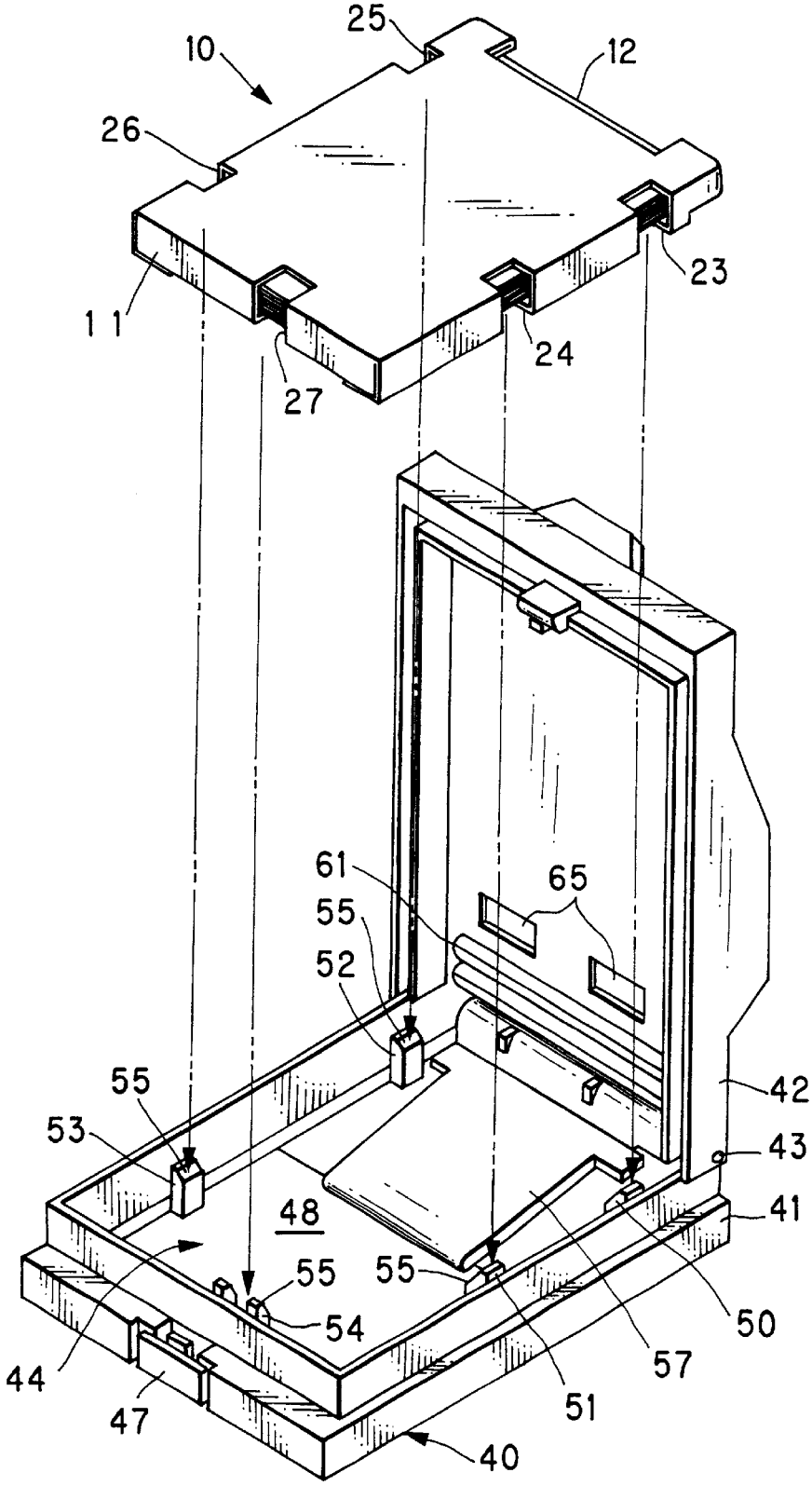
FIG. 7 is a perspective illustrating an open state of the sheet supply cassette with the recording sheet package.

In FIGS. 6 and 7, a sheet supply cassette 40 to contain the recording sheet package 10 is illustrated. The sheet supply cassette 40 is constituted by a cassette body 41 and a lid 42, and generally has a box shape.

Figure 8:
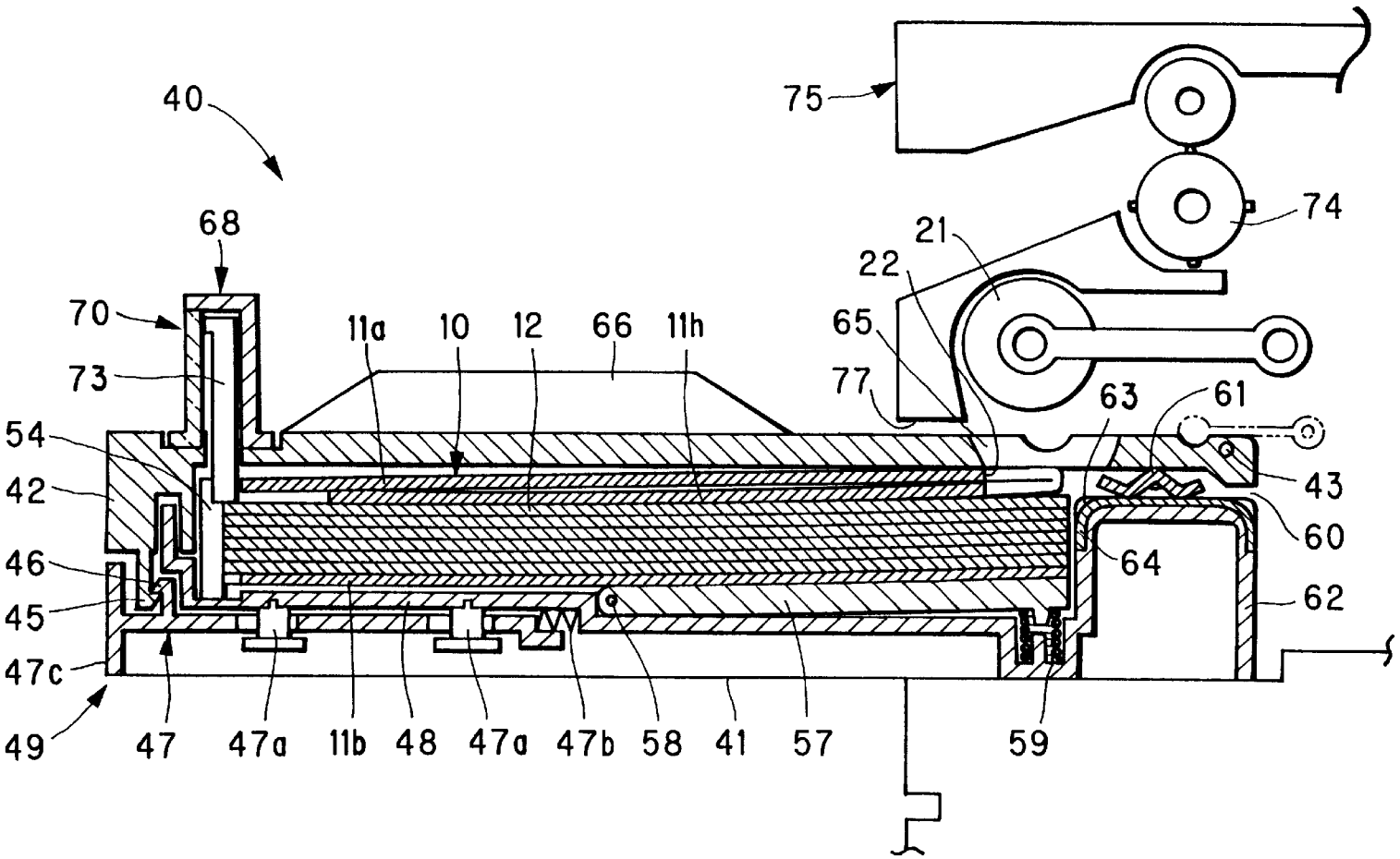
FIG. 8 is an explanatory view in section, illustrating the sheet supply cassette in a state inserted in a thermal printer.

The lid 42 is supported on the cassette body 41 in a rotatable manner about an axis defined by a pivot 43, and is openable within an angle range of approximately 90 degrees. In FIG. 7, an inner surface 44 of the cassette body 41 is loaded with the recording sheet package 10 while the lid 42 is kept open erectly. When the lid 42 is closed, retainer hooks 45 and 46 of a lock mechanism 49 in FIG. 8 are engaged with each other to keep the lid 42 closed.

The lock mechanism 49 is constituted by the retainer hook 45 on the lid 42 and a lock plate 47, which is kept slidable in the supply direction by support shafts 47*a* on a bottom plate 48. The lock plate 47 has the retainer hook 46, which is engaged with the retainer hook 45. The lock plate 47 is biased by a coil spring 47*b* in a direction of engaging the retainer hooks 45 and 46. When the lid 42 is closed, the retainer hooks 45 and 46 of the lock mechanism 49 are retained on each other to keep the lid 42 closed. An operation plate 47*c* of the lock plate 47 is pushed to disengage the retainer hook 45 from the retainer hook 46, so that the lid 42 is rendered openable.

In FIG. 7, the inner surface 44 has a slightly greater area than the recording sheet package 10 so as to facilitate the loading operation. Loading guiding projections 50–54 are arranged on the bottom plate 48 of the cassette body 41 in positions of the loading engaging cutouts 23–27. The loading guiding projections 50–54 respectively have a rectangular shape, and are provided with a guide surface 55 on the top. The guide surface 55 is inclined, and causes the loading guiding projections 50–54 smoothly to enter the loading engaging cutouts 23–27.

When the recording sheet package 10 is set on the inner surface 44 in the correct position, the loading guiding projections 50–54 enter the loading engaging cutouts 23–27 to allow loading the recording sheet package 10 on the inner surface 44. If the recording sheet package 10 is set on the inner surface 44 with a left lateral side of the recording sheet package 10 oriented to the right, or with its front edge oriented to the rear, then the loading guiding projections 50–54 are not opposed to the loading engaging cutouts 23–27. The recording sheet package 10 cannot be inserted and can be found to be incorrectly set. A user is enabled to reinsert the recording sheet package 10 in the sheet supply cassette 40 by correcting the orientation of the recording sheet package 10.

Figure 10:
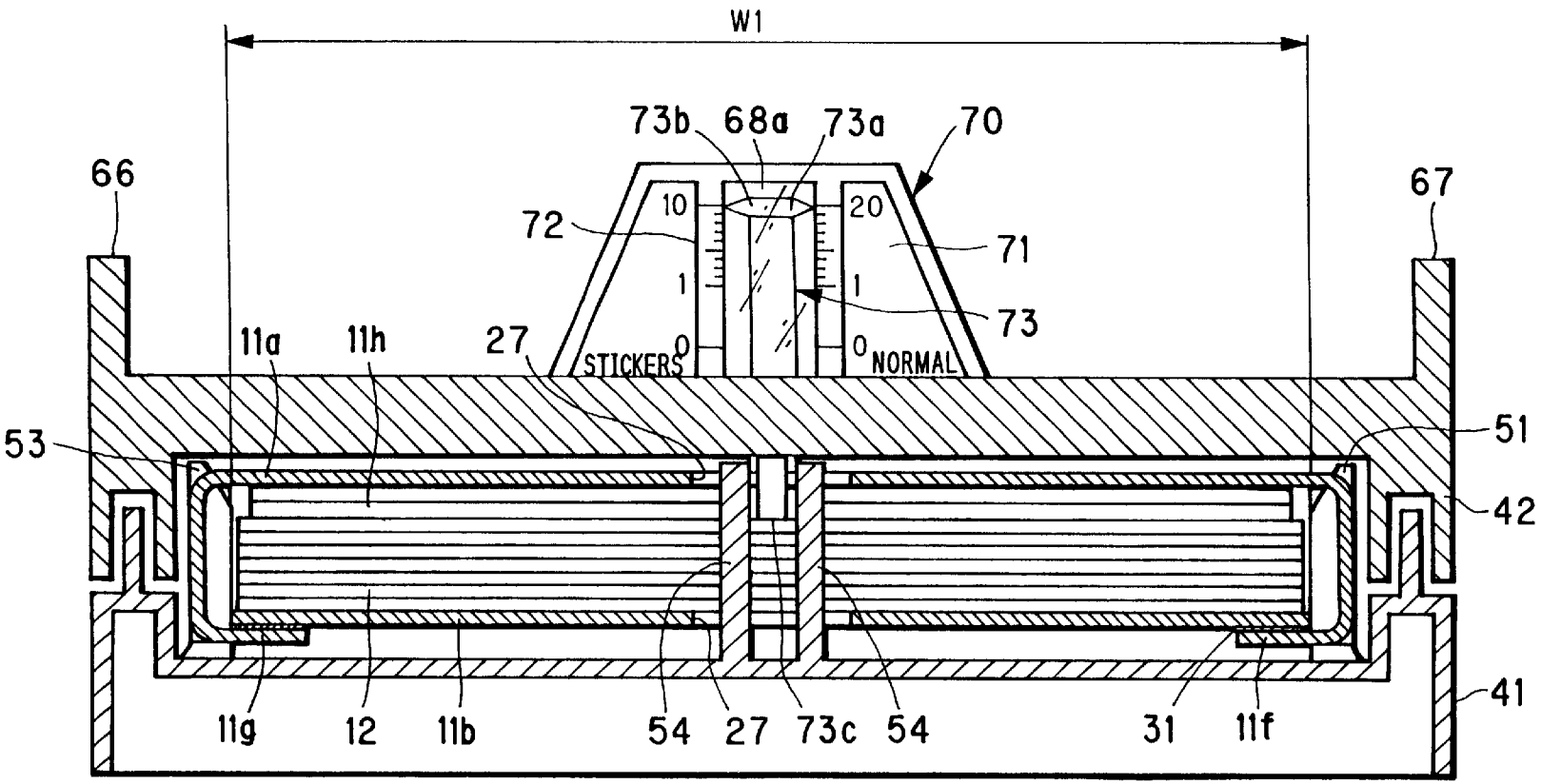
FIG. 10 is a cross section illustrating the sheet supply cassette containing the recording sheet package.

The loading guiding projections 50–53 are laterally disposed as two pairs. In FIG. 10, let W1 a distance from the level of the loading guiding projections 50 and 51 to the level of the loading guiding projections 52 and 53. The distance W1 is determined slightly greater than the width of the recording sheets. Thus the lateral sides of the recording sheets 12 are neatly set by entry of the loading guiding projections 50–53 into the packaging body 11 through the loading engaging cutouts 23–26. Also the recording sheets 12 are positioned in the direction crosswise to the supply direction of the recording sheets 12. Even though the recording sheets 12 are loosely contained in the packaging body 11, the recording sheets 12 are not supplied in accidentally oblique movement. The recording sheets 12 are prevented from being jammed or provided with an obliquely printed image, as the recording sheets 12 do not move obliquely.

In FIG. 8, the rear edges of the recording sheets 12 are arranged neatly by the loading guiding projection 54 which is located opposite to a sheet supply passageway 60. The loading guiding projection 54 also tightly positions the recording sheets 12 in the supply direction. If the recording sheets 12 are loosely contained in the packaging body 11, setting of the recording sheet package 10 in the sheet supply cassette 40 automatically tightens the recording sheets 12 in the supply direction.

A lifter plate 57 is disposed on the inner surface 44. In FIG. 8, the lifter plate 57 is supported on the bottom plate 48 rotatably about an axis defined by a pivot 58. The lifter plate 57 is biased upwards by a coil spring 59, to push up the bottom plate 11*b* of the recording sheet package 10.

A gap is formed between the cassette body 41 and the lid 42 in the vicinity of the pivot 43 while the lid 42 is closed. This gap constitutes the sheet supply passageway 60. A spring plate 61 is disposed in a path near to the sheet supply passageway 60 on the side of the lid 42. The spring plate 61 biases the recording sheets 12 toward a wall of the path on the side of the cassette body 41.

A recording sheet separator 62 is disposed to project in a supply path near to the sheet supply passageway 60 on the side of the cassette body 41. A cork member 63 is attached to the surface of the recording sheet separator 62. When two of the recording sheets 12 remain overlapped on one another while supplied, the cork member 63 frictionally stops the lower one of the two of the recording sheets 12 from advancing. Thus only the uppermost one of the recording sheets 12 is allowed to advance each time. Furthermore the recording sheet separator 62 has two separator projections 64 for avoiding double supply of the recording sheets 12. The separator projections 64 contact the lower one of the two of the recording sheets 12, to stop it from advancing.

In FIG. 8, roller openings 65 are formed in the lid 42 in positions corresponding to the roller receiving recess 22 in the recording sheet package 10. In a thermal printer 75, the sheet supply cassette 40 is set, so as to cause portions of the supply roller 21 to enter the roller openings 65. The supply roller 21 contacts the uppermost one of the recording sheets 12 in the recording sheet package 10. The supply roller 21 rotates in the supply direction in the course of printing. Thus only the uppermost one of the recording sheets 12 is advanced from the recording sheet package 10 toward a printing stage in the thermal printer 75.

Figure 9:
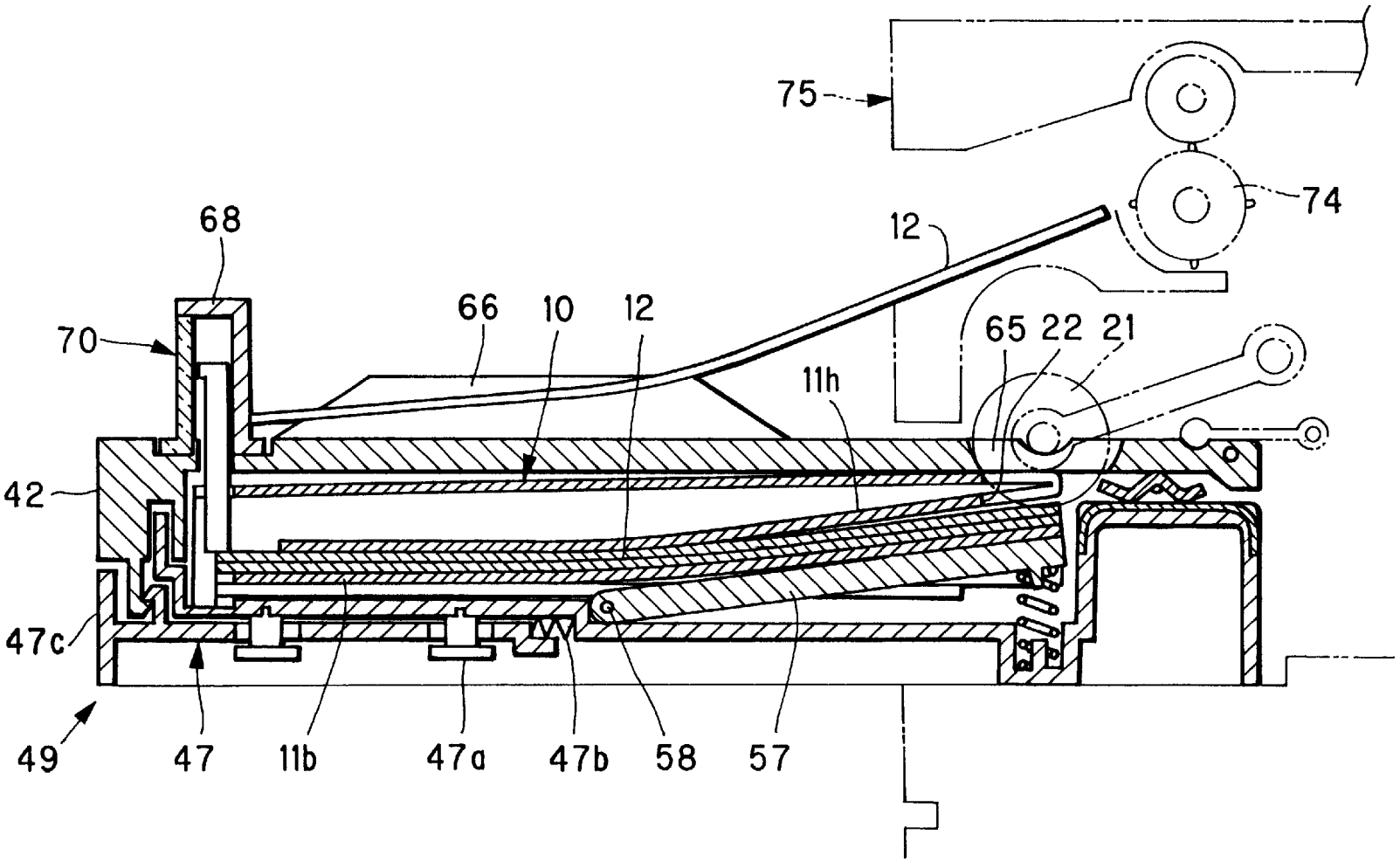
FIG. 9 is an explanatory view in section, illustrating the sheet supply cassette in a step of ejecting the recording sheet.

In FIGS. 6 and 9, a top face of the lid 42 consists of an ejection tray. Recording sheet guide members 66 and 67 and a stopper 68 are disposed on the lid 42. The recording sheet guide members 66 and 67 regulate lateral sides of an ejected one of the recording sheets 12, and lie along the longer side lines of the lid 42. The stopper 68 prevents the ejected one of the recording sheets 12 from dropping away from the lid 42 by contacting an advancing edge of the recording sheets 12.

A remainder indicator 70 is disposed on the stopper 68. In FIG. 10, the remainder indicator 70 is constituted by gradations 71 and 72 and a pointer 73, which points a position in the gradations 71 and 72. The number of the remaining ones of the recording sheets 12 is indicated by cooperation of the pointer 73 and the gradations 71 and 72.

Triangular pointer ends 73*a* and 73*b* are disposed on the top of the pointer 73, and point the gradations 71 and 72. A transparent plate 68*a* is disposed in front of the pointer ends 73*a* and 73*b* to cover the pointer ends 73*a* and 73*b* in an externally visible manner. The transparent plate 68*a* consists of an ultraviolet cut filter. The transparent plate 68*a* avoids entry of fixing rays, which would influence the coloring ability of the recording sheets 12.

The pointer 73 is movable in the thickness direction of the recording sheets 12 inside the stopper 68. The weight of the pointer 73 causes a bottom end 73*c* of the pointer 73 to contact the uppermost one of the recording sheets 12 through the loading engaging cutout 27.

The gradations 71 and 72 are disposed beside the pointer 73. The gradations 71 are included in a scale for the recording sheets 12 of an ordinary type, and are "20" down to "0" (zero). The gradations 72 are included in a scale for thermal printing stickers having a greater thickness, and are "10" down to "0" (zero).

In the present invention, the gradations 71 and 72 are provided with quantitative signs only to indicate "maximum" and "emptiness". For the middle levels, the gradations 71 and 72 indicate information only upon being pointed by the pointer ends 73*a* and 73*b*. Of course the unit interval of the gradations 71 and 72 can be associated with one or two sheets, or any suitable predetermined number of sheets. Furthermore, portions for the middle levels in the gradations 71 and 72 may be blank. It is possible to use a coil spring to bias the pointer 73 downwards instead of the weight of the pointer 73, for the purpose of causing the bottom end 73*c* of the pointer 73 to contact the uppermost one of the recording sheets 12.

Figure 11:
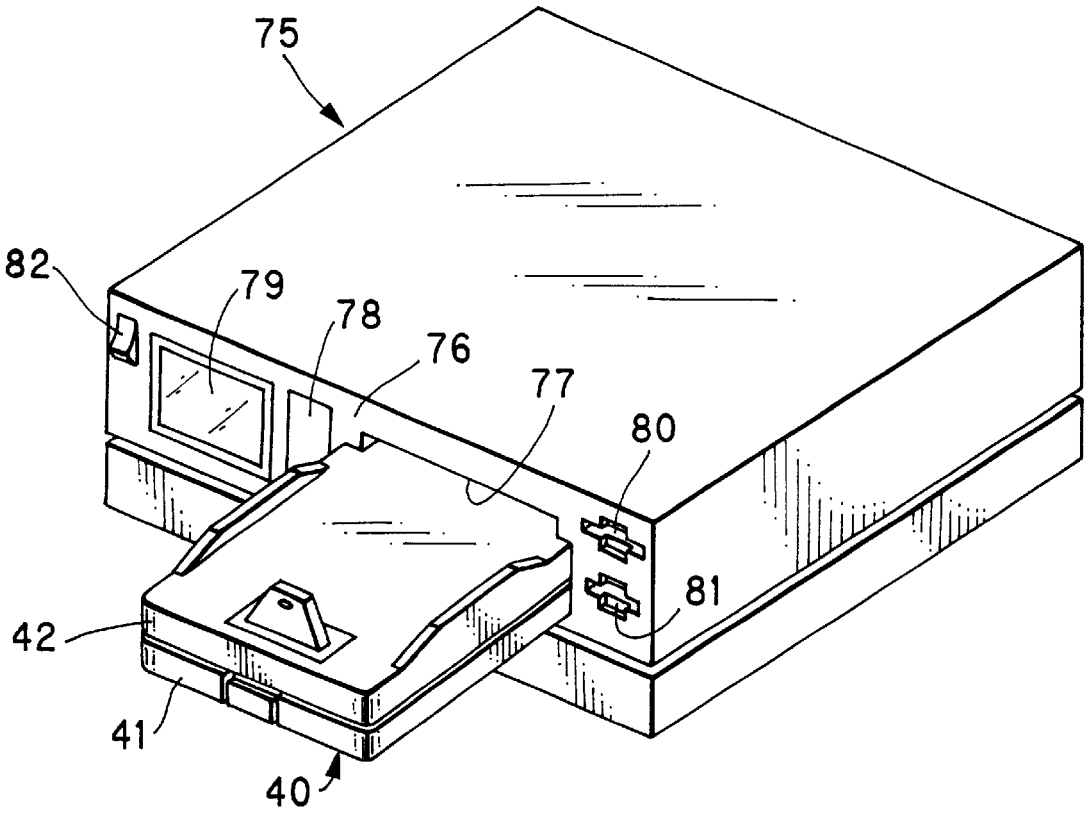
FIG. 11 is a perspective illustrating the thermal printer loaded with the sheet supply cassette.

In FIG. 11, the thermal printer 75 is illustrated. A front face 76 of the thermal printer 75 has a cassette loading port 77, into which the sheet supply cassette 40 is inserted. In FIG. 9, portions of the supply roller 21 in the cassette loading port 77 enter the roller openings 65 in the lid 42 when the sheet supply cassette 40 is set in the cassette loading port 77. As the recording sheets 12 in the sheet supply cassette 40 are kept pushed up by the lifter plate 57, the uppermost one of the recording sheets 12 contacts the supply roller 21.

The front face 76 has the cassette loading port 77 with an operation panel 78, a liquid crystal display (LCD) panel 79, an IC card insertion port 80, a smart media insertion port 81 and a power switch 82. When the operation panel 78 is operated to enter printing instructions, an image to be printed is displayed in the LCD panel 79. After checking the displayed image, a printing key in the operation panel 78 is operated to start printing.

For the printing, the supply roller 21 is rotated in the supply direction at first. The uppermost one of the recording sheets 12 is advanced and supplied into the thermal printer 75. A thermal head is driven to print an image to the one of the recording sheets 12 in a three-color frame-sequential recording. The image is recorded one line after another. The thermal head is driven for each pixel to be recorded in synchronism with the conveyance of the one of the recording sheets 12. Also an ultraviolet lamp is driven upon the thermal recording for the color having been recorded. Thus the image of this color is fixed, not to develop color further in the following steps of the recording. After the three-color frame-sequential recording, the one of the recording sheets 12 in FIG. 9 is ejected by an ejector roller 74 to the lid 42 of the sheet supply cassette 40, to finish the printing operation.

To load the sheet supply cassette 40 with the recording sheet package 10, at first the sheet supply cassette 40 is removed from the cassette loading port 77 in the thermal printer 75. In FIG. 7, the lid 42 is opened. If the packaging body 11 emptied after the previous use remains in the sheet supply cassette 40, the packaging body 11 is removed before the recording sheet package 10 is inserted. The loading engaging cutouts 23–27 in the packaging body 11 are positioned at each of the loading guiding projections 50–54 of the inner surface 44. Therefore the recording sheet package 10 is correctly set on the inner surface 44. The loading guiding projections 50–54 also operate to neaten the end of the recording sheets 12, which are automatically positioned in the supply station.

If the recording sheet package 10 is erroneously oriented to be set on the inner surface 44, for example if a left lateral side of the recording sheet package 10 is oriented to the right, or its front edge is oriented to the rear, then at least one of the loading guiding projections 50–54 is not received in the loading engaging cutouts 23–27 but interferes with the periphery of the recording sheet package 10. Thus the recording sheet package 10 can be set in a correct orientation on the inner surface 44. No wasteful recording operation occurs. Recording heat is prevented from being applied to the back surface of the recording sheet 12. The heating element array of the thermal head would be damaged if it should heat the back surface of the recording sheet 12. But the heating element array is protected from being damaged in accordance with the present invention.

If the recording sheets 12 are replaced with thermal printing stickers having the greater thickness, the recording sheet package is replaced. If the recording sheet package 10 is removed, the recording sheet package 10 is inserted into the outer packaging bag 13 of FIG. 4. The fastener 15 is closed to preserve the recording sheet package 10 in a moisture-shielded and light-shielded state.

After the recording sheet package 10 is removed from the sheet supply cassette 40, the push plate 11*h* still pushes the recording sheets 12 toward the bottom plate 11*b* no matter how small the number of the remainder of the recording sheets 12 in the recording sheet package 10. Thus the recording sheets 12 are prevented from falling out of the packaging body 11 by means of the push plate 11*h* and the bottom plate 11*b*.

Figure 12:
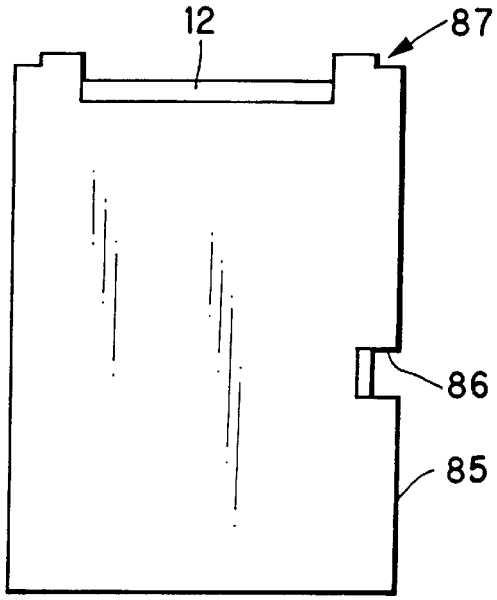
FIG. 12 is a plan illustrating another preferred recording sheet package having one loading engaging cutout.
Figure 13:
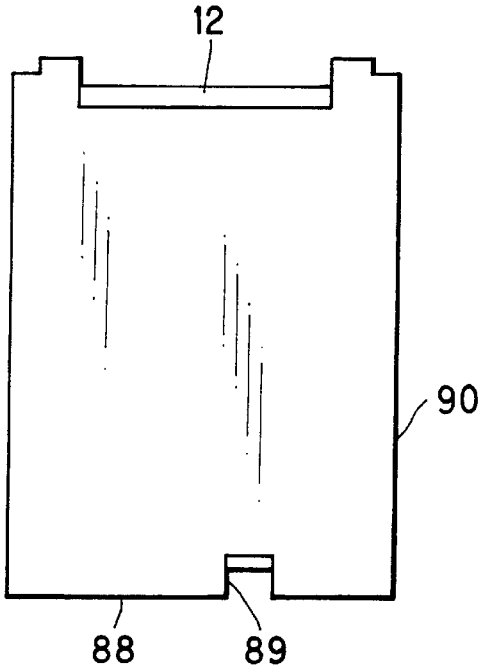
FIG. 13 is a plan illustrating a recording sheet package in which a loading engaging cutout is differently located.

In FIGS. 12 and 13, only one loading engaging cutout is formed instead of the five loading engaging cutouts 23-27. In FIG. 12, a recording sheet package 87 has one loading engaging cutout 86 formed in a position on a longer side line 85. The loading engaging cutout 86 makes the peripheral line asymmetric with respect to the reference line perpendicular to the advance of the recording sheets 12. As the loading engaging cutout 86 is received by a loading guiding projection, the loading guiding projection in cooperation with the loading engaging cutout 86 can operate to avoid incorrect loading of the recording sheet package 87. In FIG. 13, a recording sheet package 90 has one loading engaging cutout 89 formed in a position on a shorter side line 88. Incorrect loading of the recording sheet package 90 is avoided, because the loading engaging cutout 89 makes the peripheral line asymmetric with respect to the reference line parallel with the advance of the recording sheets 12.

Figure 14:
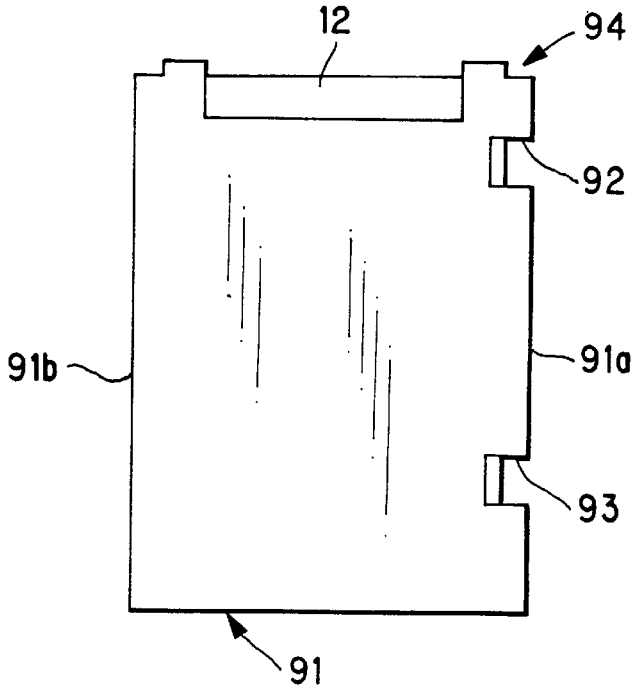
FIG. 14 is a plan illustrating a recording sheet package with two loading engaging cutouts.

In FIG. 14, a recording sheet package 94 includes a packaging body 91, in which loading engaging cutouts 92 and 93 are formed in a longer side line 91*a* of the packaging body 91. The loading engaging cutouts 92 and 93 are located in asymmetric positions with respect to the reference line of the packaging body 91 perpendicular to the supply direction. Thus the recording sheets 12 can be pushed toward a longer side line 91*b* opposite to the longer side line 91*a* by guiding projections inserted in the loading engaging cutouts 92 and 93. At the same time the recording sheets 12 can be correctly set in the supply position. Errors in the orientation of the recording sheet package 94 are avoided.

Figure 15:
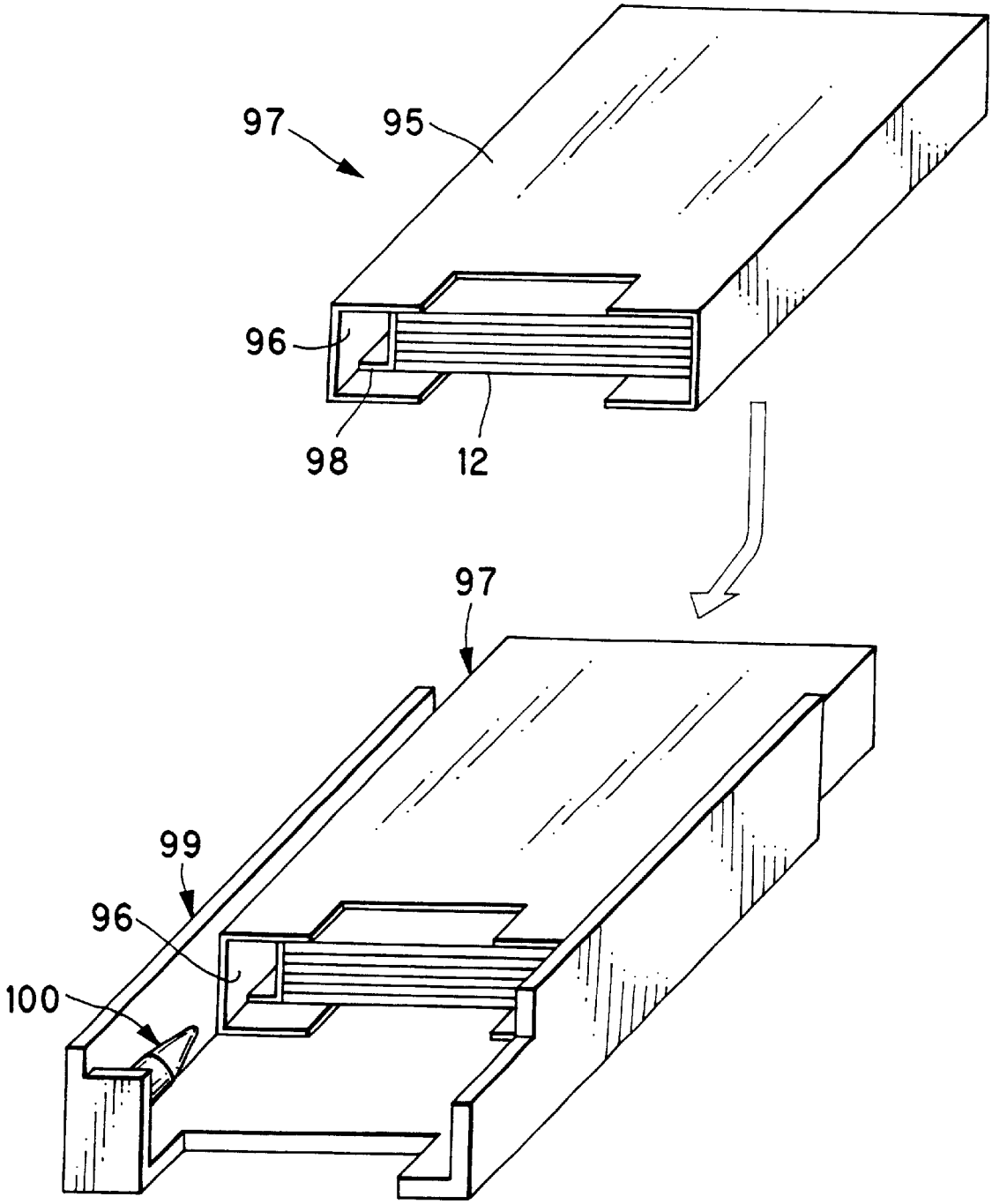
FIG. 15 is a perspective illustrating a sheet supply cassette with a recording sheet package in which a spacer pushes the recording sheets on one inner side.

In FIG. 15, a recording sheet package 97 has a loading engaging gap 96 instead of the cutouts. The loading engaging gap 96 is defined between a packaging body 95 and the recording sheets 12. A spacer 98 is disposed in the packaging body 95 to define the loading engaging gap 96. The spacer 98 consists of a guide plate of paper or cardboard bent in an L-shape. A spring (not shown) biases the spacer 98 to push the recording sheets 12 on one inner side of the packaging body 95. Thus the loading engaging gap 96 is formed in the packaging body 95.

Figure 16:
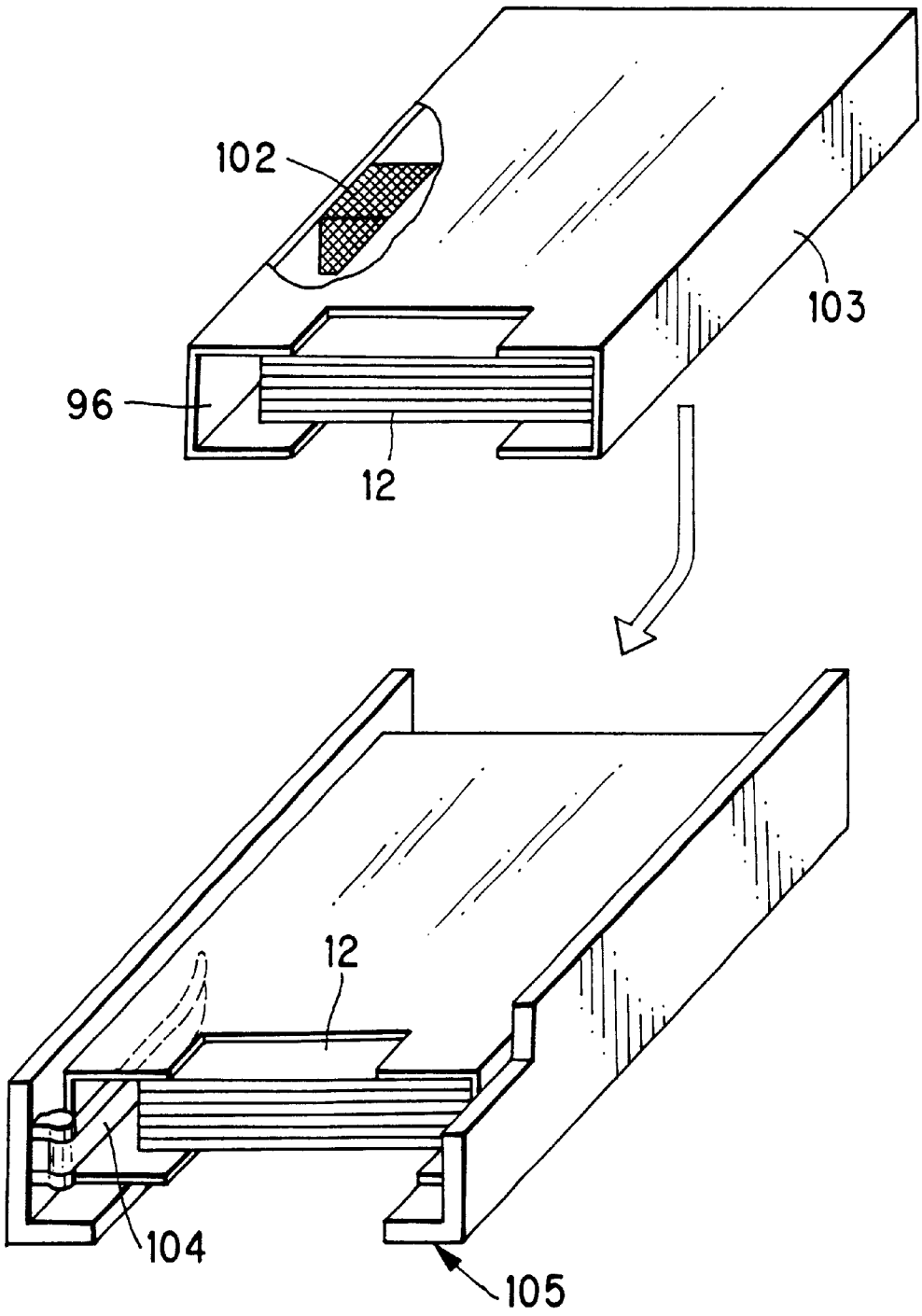
FIG. 16 is a perspective illustrating a sheet supply cassette with a recording sheet package in which a sponge spacer is used.

A sheet supply cassette 99 has a loading guiding projection 100, which enters the loading engaging gap 96 only when the recording sheet package 97 is oriented correctly. The loading guiding projection 100 is formed in a combined shape of a cone and a cylinder. The loading guiding projection 100 inhibits the recording sheet package 97 from being loaded unless the recording sheet package 97 is correctly oriented. Thus the recording sheet package 97 can be loaded reliably in an exact manner. Note that a sponge spacer 102 in FIG. 16 may be used for defining the loading engaging gap 96 instead of the spacer 98 or in addition to the spacer 98. The use of the sponge spacer 102 is effective in smoothing the insertion of the recording sheets 12 into a packaging body 103 in the course of the manufacture. Also a sheet supply cassette 105 having a loading guiding projection plate 104 of FIG. 16 may be used instead of the loading guiding projection 100 of FIG. 15. The loading guiding projection plate 104 is biased by a spring, and keeps the recording sheets 12 located on one side in the packaging body 103.

Figure 17:
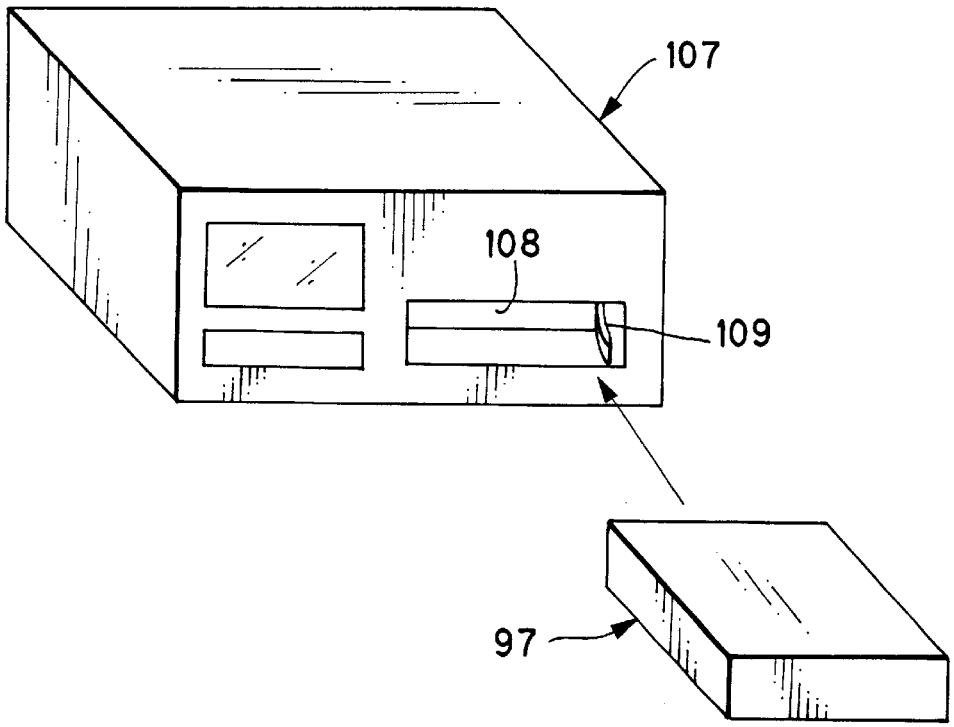
FIG. 17 is a perspective illustrating a thermal printer loadable with the recording sheet package directly.

In FIG. 17, no supply cassette is used. A thermal printer 107 has a sheet loading port 108 into which the recording sheet package 97 is inserted directly. A loading guiding projection 109 is disposed on the inside of the sheet loading port 108 for a position of the loading engaging gap 96 of FIG. 15. The loading guiding projection 109 avoids incorrect loading of the recording sheet package 97, and also neatens the lateral sides of the recording sheets by pushing them in one direction. Note that a combination of a cutout and a guiding projection similar to the above embodiment may be used instead of the loading engaging gap 96 and the loading guiding projection 109 for the purpose of neatening the lateral sides of the recording sheets. In such an example, the guiding projection is inserted in the cutout after the package is inserted in the printer.

Figure 18:
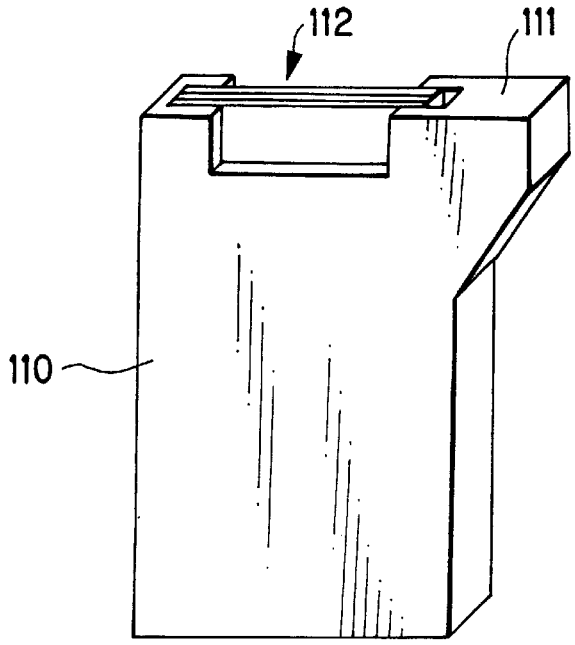
FIG. 18 is a perspective illustrating another preferred recording sheet package having a protruding shape.

In FIG. 18, a recording sheet package 112 has a packaging body 110 in which a loading engaging projection 111 is formed on the periphery instead of cutouts or recesses. For use with the recording sheet package 112, a sheet supply cassette is provided with a recess (not shown) in a position opposed to the loading engaging projection 111, so that the loading engaging projection 111 can operate for avoiding errors in loading the recording sheet package 112 by means of interference of the loading engaging projection 111 with the sheet supply cassette. Also a packaging body can have a loading engaging deformed portion (not shown) formed on the periphery instead of the loading engaging projection 111. A sheet supply cassette can be provided with a complementarily shaped portion (not shown) in a position opposed to the deformed portion, so that the deformed portion can operate for avoiding errors in loading the recording sheet package.

Figure 19:
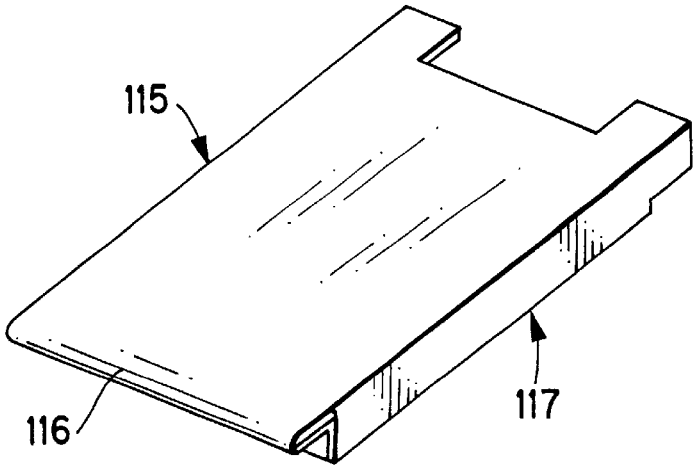
FIG. 19 is a perspective illustrating a recording sheet package having a loading engaging ridge formed along a shorter side line.

In FIG. 19, a recording sheet package 117 has a packaging body 115 in which a loading engaging ridge 116 is formed along a shorter side line of the packaging body 115. For use with the recording sheet package 117, a supply cassette is provided with a groove or slit for the position of the loading engaging ridge 116. When the loading engaging ridge 116 is safely received in the groove or slit, the recording sheet package 117 is acceptably loaded.

Figure 20:
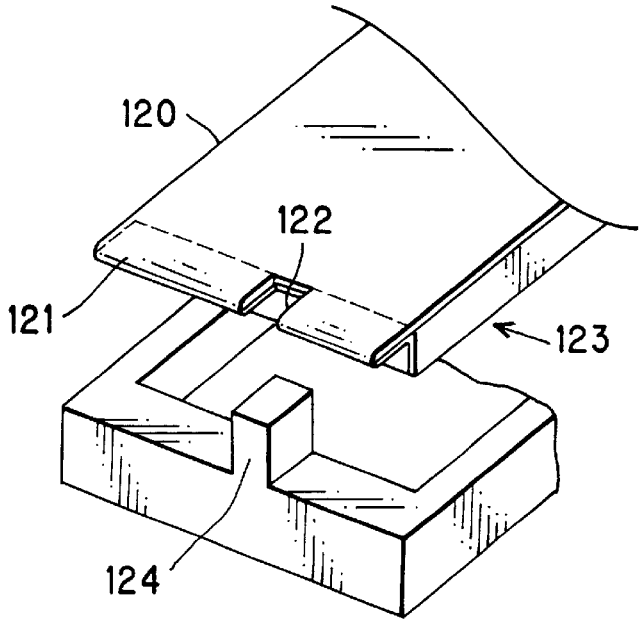
FIG. 20 is a perspective illustrating a recording sheet package having a loading engaging cutout formed in a loading engaging ridge.
Figure 21:
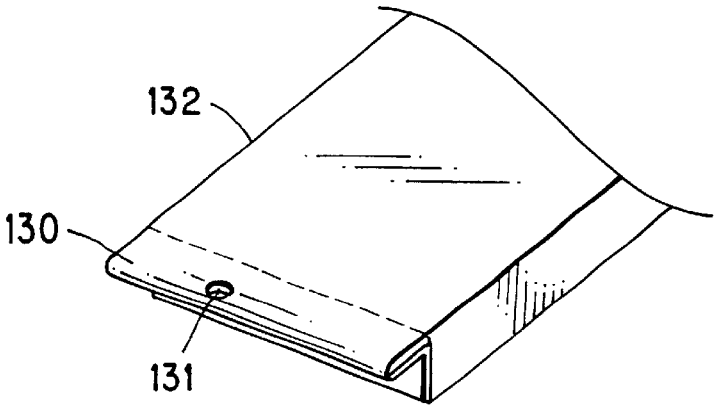
FIG. 21 is a perspective illustrating a recording sheet package having a loading engaging hole formed in a loading engaging ridge.

In FIG. 20, a recording sheet package 123 has a packaging body 120 in which a loading engaging cutout 122 is formed in a loading engaging ridge 121 in a position asymmetric with respect to the supply direction. For use with the recording sheet package 123, a sheet supply cassette can be provided with a loading guiding projection 124 corresponding to the loading engaging cutout 122. When the loading engaging cutout 122 is fitted on the loading guiding projection 124, the recording sheet package 123 is allowed to be set in the sheet supply cassette in the predetermined acceptable position. In FIG. 21, a recording sheet package 132 includes a loading engaging hole 131 formed in a loading engaging ridge 130. The loading engaging hole 131 is also in a position asymmetric with respect to the supply direction. The loading engaging hole 131 is used to allow the acceptable loading of the recording sheet package 132.

Figure 22:
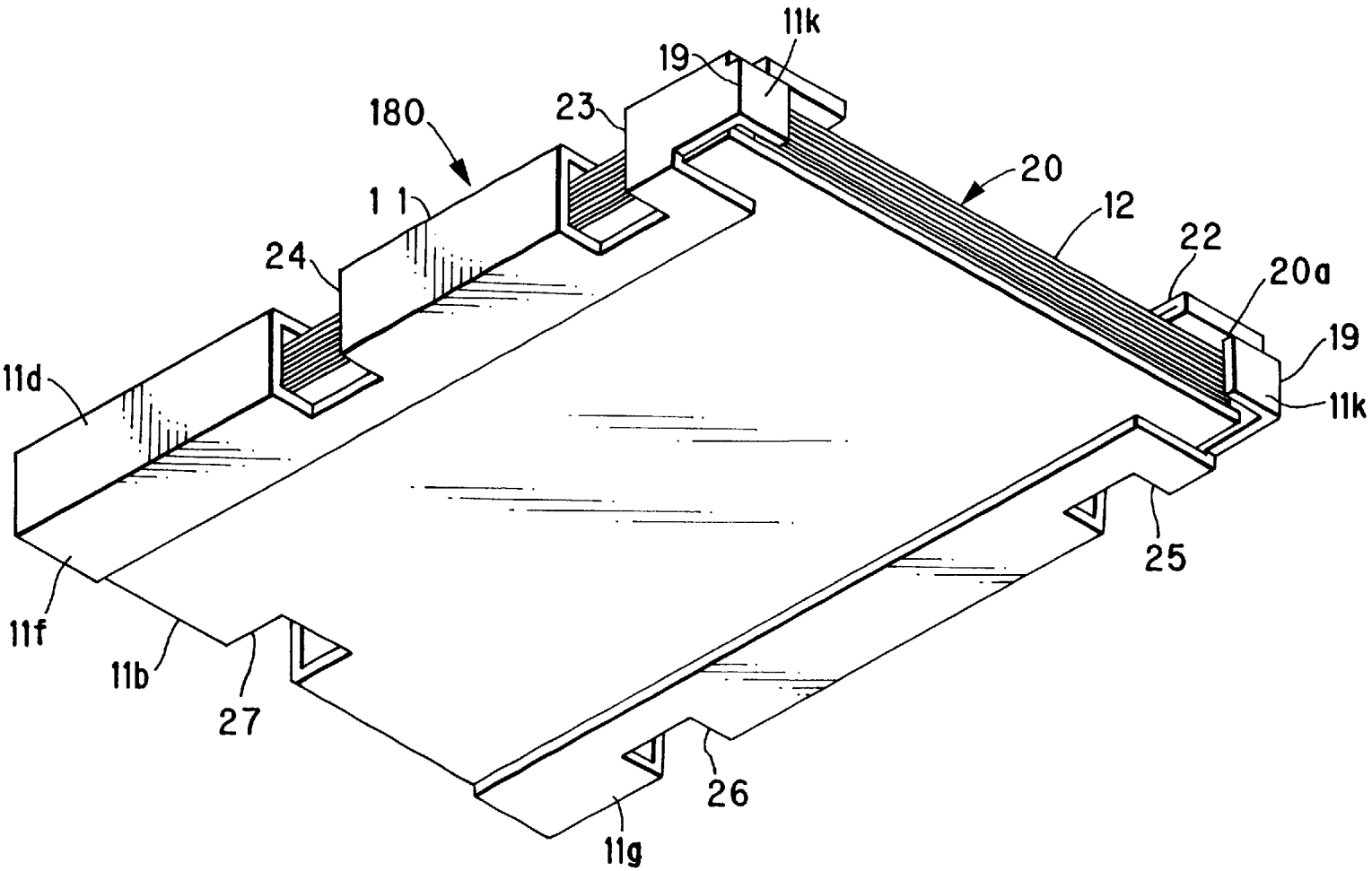
FIG. 22 is a bottom perspective illustrating still another preferred recording sheet package having anti-dropping projections.

In FIG. 22, another preferred embodiment is illustrated, in which recording sheets are prevented from dropping out of the supply opening. A recording sheet package 180 has a pair of anti-dropping projections 11*k* formed respectively with the lateral plates 11*d* and 11*e* of the packaging body 11. The present embodiment is the same as that of FIGS. 1–3 and 5 except for the anti-dropping projections 11*k*. Elements similar to those of the above embodiments are designated with identical reference numerals. The anti-dropping projections 11*k* are located on lateral ends of the supply opening, and bent with the bend lines 19 at the angle of 90 degrees from the lateral plates 11*d* and 11*e*. An upper open end 20*a* or slot-shaped passageway is formed between the top edge of the anti-dropping projections 11*k* and the top plate 11*a*, for allowing passage of only one of the recording sheets 12. As the recording sheets 12 are squeezed between the bottom plate 11*b* and the push plate 11*h*, the uppermost one of the recording sheets 12 does not drop out of the upper open end 20*a* even if the supply opening is simply directed downwards.

In the above embodiment, the anti-dropping projections 11*k* are formed by bending extension of the lateral plates 11*d* and 11*e*. But the anti-dropping projections 11*k* may be originally formed in a separate manner from the lateral plates 11*d* and 11*e*, and may be subsequently fixed to the lateral plates 11*d* and 11*e*. For this fixation, reinforcing members (not shown) may be attached to the anti-dropping projections 11*k* to keep the anti-dropping projections 11*k* from bending easily.

Figure 23:
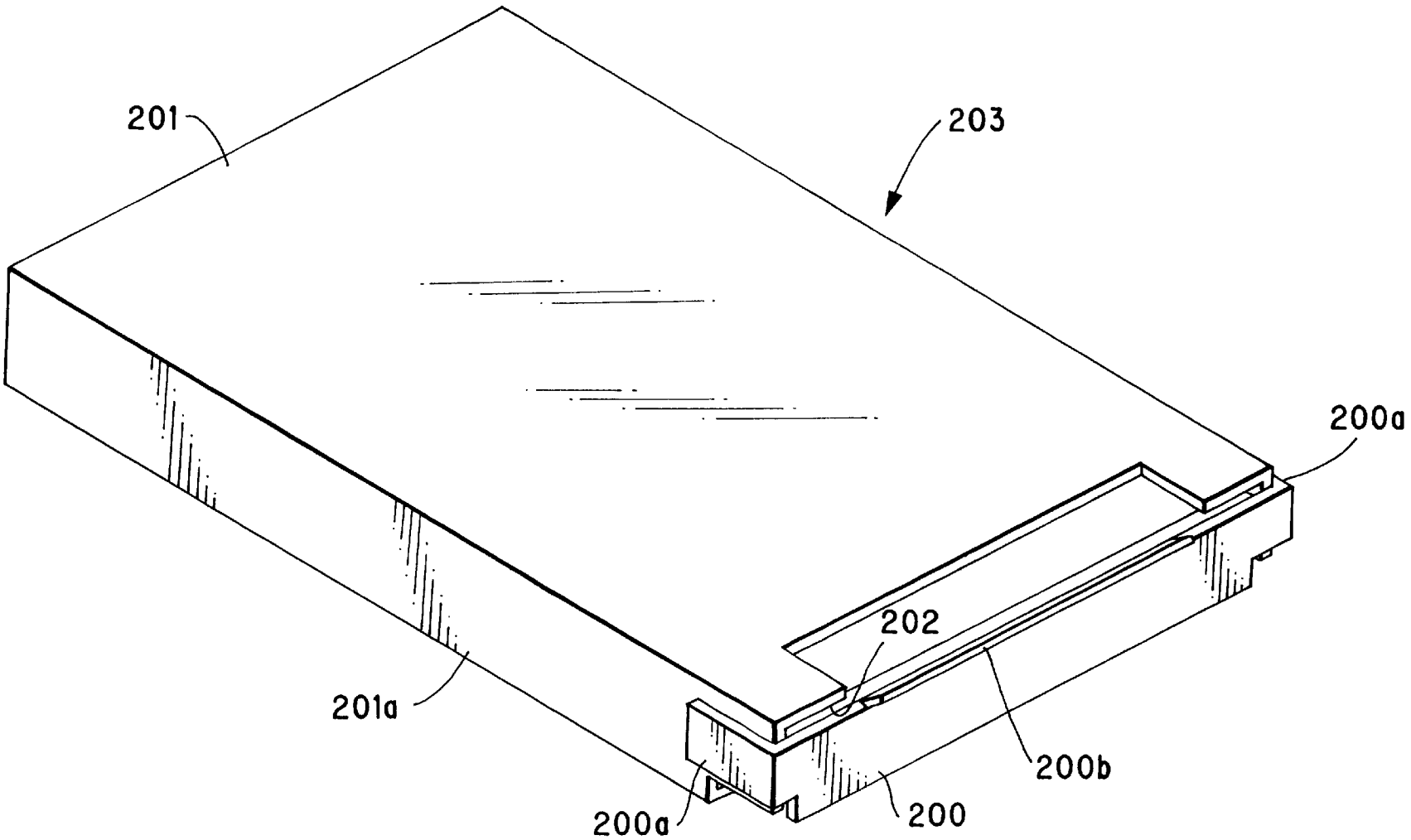
FIG. 23 is a perspective illustrating a recording sheet package having an anti-dropping plate.

In FIG. 23, a recording sheet package 203 includes an anti-dropping plate 200 instead of the anti-dropping projections 11*k*. The anti-dropping plate 200 is prepared separately from a packaging body 201. The anti-dropping plate 200 has a channel shape provided with bend ends 200*a*. Adhesive agent is applied to the bend ends 200*a* to attach the anti-dropping plate 200 to lateral plates 201*a* of the packaging body 201. A guide ridge 200*b* is formed with the anti-dropping plate 200 at an upper open end 202 by bending an edge portion of the anti-dropping plate 200 outwards with an inclination. The guide ridge 200*b* smoothens the advance of the uppermost one of the recording sheets 12 and eliminates interference of the anti-dropping plate 200.

Figure 24:
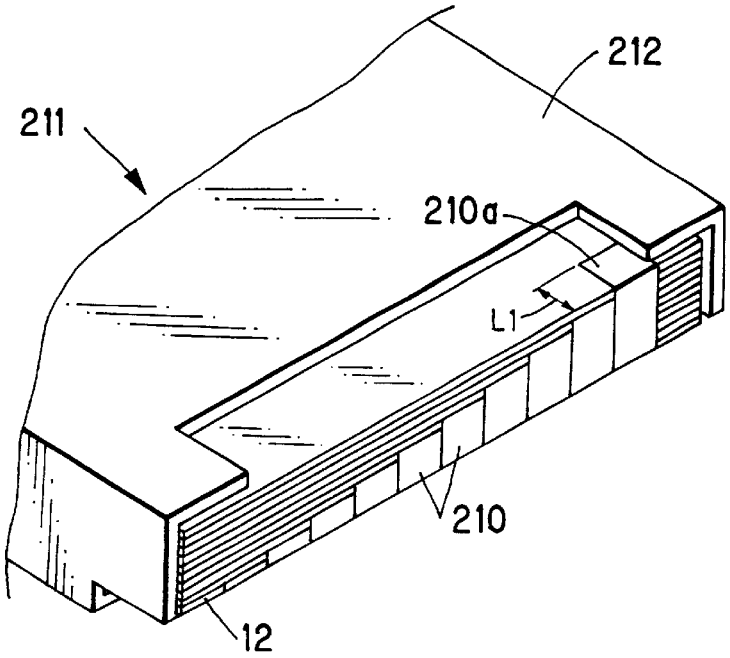
FIG. 24 is a perspective, partially cutaway, illustrating a recording sheet package having anti-dropping tapes.
Figure 25:
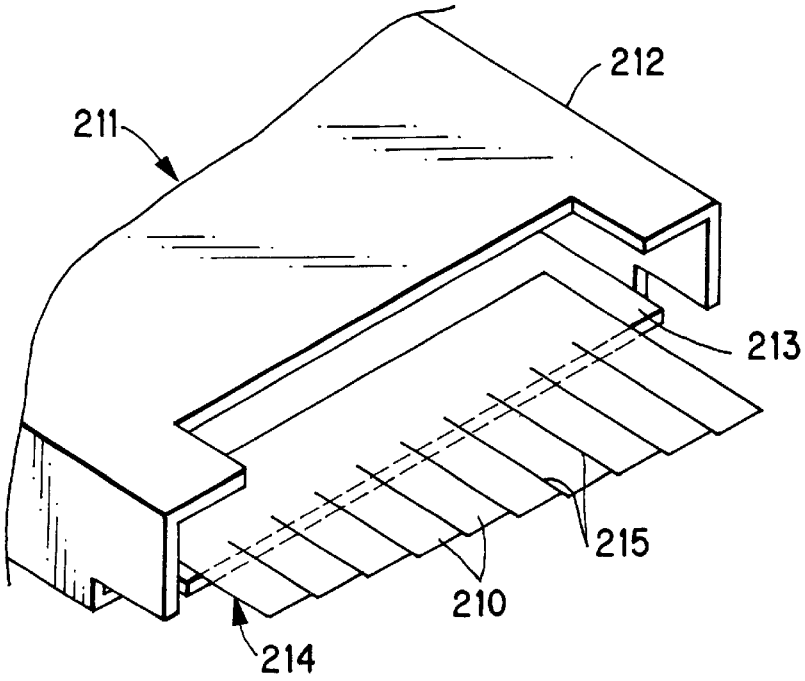
FIG. 25 is a perspective, partially cutaway, illustrating a packaging body of which the anti-dropping tapes are spread.

In FIG. 24, a recording sheet package 211 includes anti-dropping tapes 210, which are bent and inserted between adjacent two of the recording sheets 12 to avoid dropping of the recording sheets 12. In FIG. 25, a packaging body 212 has a bottom plate 213. To position the anti-dropping tapes 210, a bend sheet 214 is at first attached with adhesive agent to an end of the bottom plate 213 on the side of the supply opening.

The bend sheet 214 is a single thin plastic sheet, and has slits 215 parallel to the supply direction and at an equal interval. The anti-dropping tapes 210 are defined by the slits 215 in the number equal to the number of the recording sheets 12 as contained. As viewed in the supply direction, the anti-dropping tapes 210 have lengths individually determined for different numbers of the recording sheets to be sandwiched. A top bending length L1, by which a top end of the anti-dropping tapes 210 is bent on each upper face of the recording sheets 12, is equal between the anti-dropping tapes 210. The resistance against the advancing force applied in the sheet supply to the anti-dropping tapes 210 can be equal between the recording sheets 12. Note that, in spite of this embodiment, the anti-dropping tapes 210 may have an equal length for the purpose of simplifying the shape of the bend sheet 214.

A top end 210*a* of the anti-dropping tapes 210 is inserted between the recording sheets 12, and squeezed. The recording sheet package 211 of the type as illustrated contains the ten (10) recording sheets 12, so that the ten (10) anti-dropping tapes 210 are arranged. In insertion of the recording sheets 12 into the packaging body 212, one of the anti-dropping tapes 210 is placed between every two of the recording sheets 12. The leftmost one of the anti-dropping tapes 210 is bent into a position between the first and second lowest ones of the recording sheets 12. The second leftmost one of the anti-dropping tapes 210 is bent into a position between the second and third lowest ones of the recording sheets 12. The remainder of the anti-dropping tapes 210 are bent similarly. The rightmost one of the anti-dropping tapes 210 is bent but simply placed on the top of the uppermost one of the recording sheets 12.

There is no recording sheet above the uppermost one of the anti-dropping tapes 210, which is kept free. The uppermost one of the anti-dropping tapes 210 is not resistant to the sheet supply. The uppermost one of the recording sheets 12 being advanced, the uppermost one of the anti-dropping tapes 210 is unbent in the supply direction, so that the one of the anti-dropping tapes 210 does not block the advance of the succeeding one of the recording sheets 12. Upon the advance of the uppermost one of the recording sheets 12, the second uppermost one of the anti-dropping tapes 210 becomes free. Thus the second uppermost one of the recording sheets 12 is advanced with smoothness. Note that the number of the anti-dropping tapes 210 is equal to the number of the recording sheets 12 in the present embodiment, but may be different from the latter. For example, the number of the anti-dropping tapes 210 may be N times as great as the number of the recording sheets 12, so that N of the anti-dropping tapes 210 are associated each one of the recording sheets 12.

If the recording sheet package 211 is removed from the sheet supply cassette 40 with the remainder of the recording sheets 12 contained therein, the anti-dropping tapes 210 still retain the recording sheets 12, and keep the recording sheets 12 from dropping out of the packaging body 212. Note that the anti-dropping tapes 210 can be constituted by plural pieces, not the single piece of the bend sheet 214. Such plural pieces can be arranged in the width direction of the recording sheets 12 to be attached to the bottom plate 213.

Figure 26:
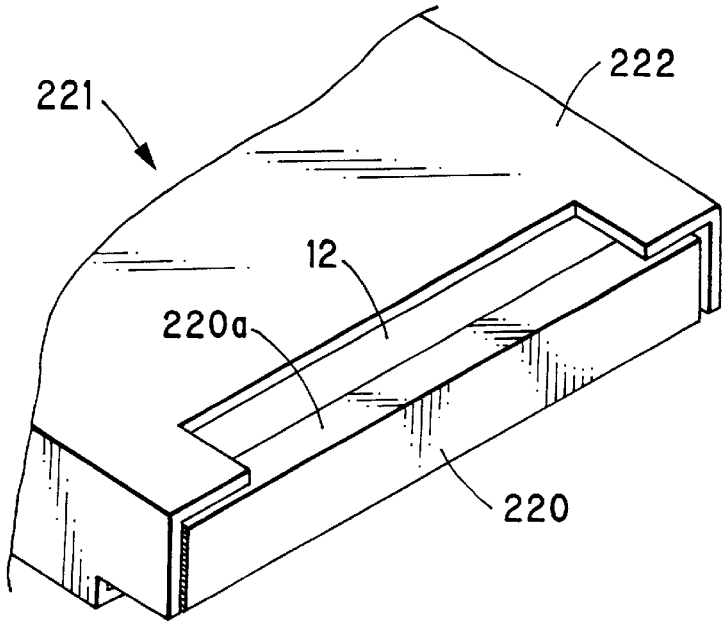
FIG. 26 is a perspective, partially cutaway, illustrating a packaging body including anti-dropping sheets stacked as a multi-sheet.

In FIG. 26, a recording sheet package 221 has anti-dropping sheets 220 instead of the anti-dropping tapes 210.

Figure 27:
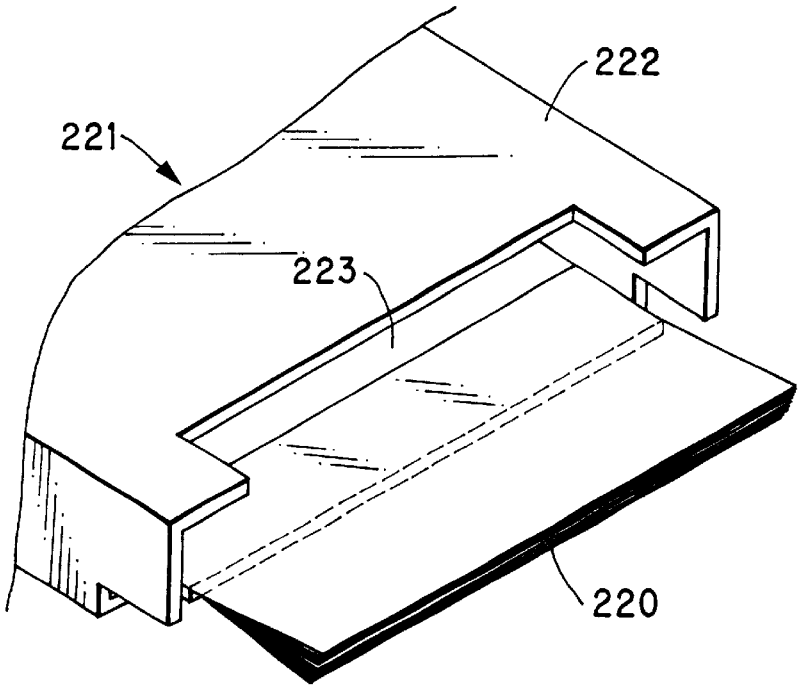
FIG. 27 is a perspective, partially cutaway, illustrating a packaging body of which the anti-dropping sheets are spread.

The anti-dropping sheets 220 have a width greater than that of the recording sheets 12, and are plastic. In FIG. 27, a multi-sheet is prepared by stacking the anti-dropping sheets 220 of which the number is equal to the number of the recording sheets 12. The anti-dropping sheets 220 are attached to an end of a bottom plate 223 of a packaging body 222 on the side of the supply opening. A top end 220*a* of the anti-dropping sheets 220 is bent and inserted between two of the recording sheets 12 to keep the recording sheets 12 from dropping out. A thickness of the anti-dropping sheets 220 is preferably small, and in the present embodiment as small as 5 $\mu$m. Of course the thickness of the anti-dropping sheets 220 may be changed suitably.

Figure 28:
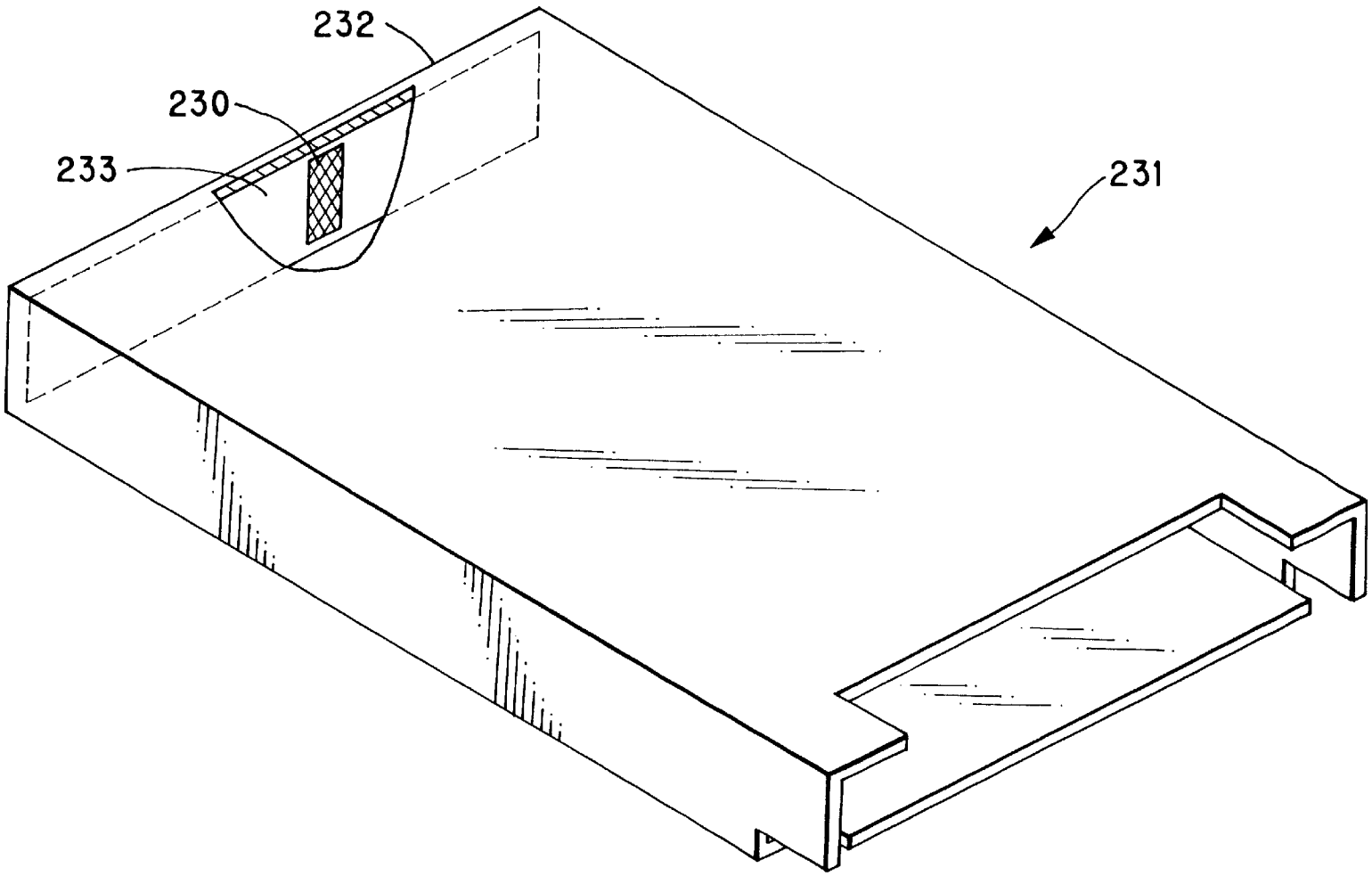
FIG. 28 is a perspective illustrating a recording sheet package in which anti-dropping adhesive agent attaches the recording sheets inside a packaging body.

In FIG. 28, a recording sheet package 231 includes anti-dropping adhesive agent 230, which prevents the recording sheets 12 from dropping out. A packaging body 232 has an end plate 233, to which the anti-dropping adhesive agent 230 is applied for attaching the recording sheets 12 to the inside of the recording sheet package 231 in a provisional manner. The anti-dropping adhesive agent 230 is disposed in the thickness direction of the recording sheets 12. The force of adhesion of the anti-dropping adhesive agent 230 is in such a range that the recording sheets 12 are not dropped out by their own weight, but that the uppermost one of the recording sheets 12 is readily separable from the end plate 233 upon application of force to advance the uppermost one. For example let each of the recording sheets 12 be 4 grams heavy. Let the sheet advancing force be 40 grams. Then the force of the adhesion of the anti-dropping adhesive agent 230 is set in a range of 20±10 grams. Note that it is also possible to dispose the anti-dropping adhesive agent 230 on the inside of one or both of the lateral plates. Of course the anti-dropping adhesive agent 230 may be disposed on the lateral plates and also on the end plate 233.

Figure 29:
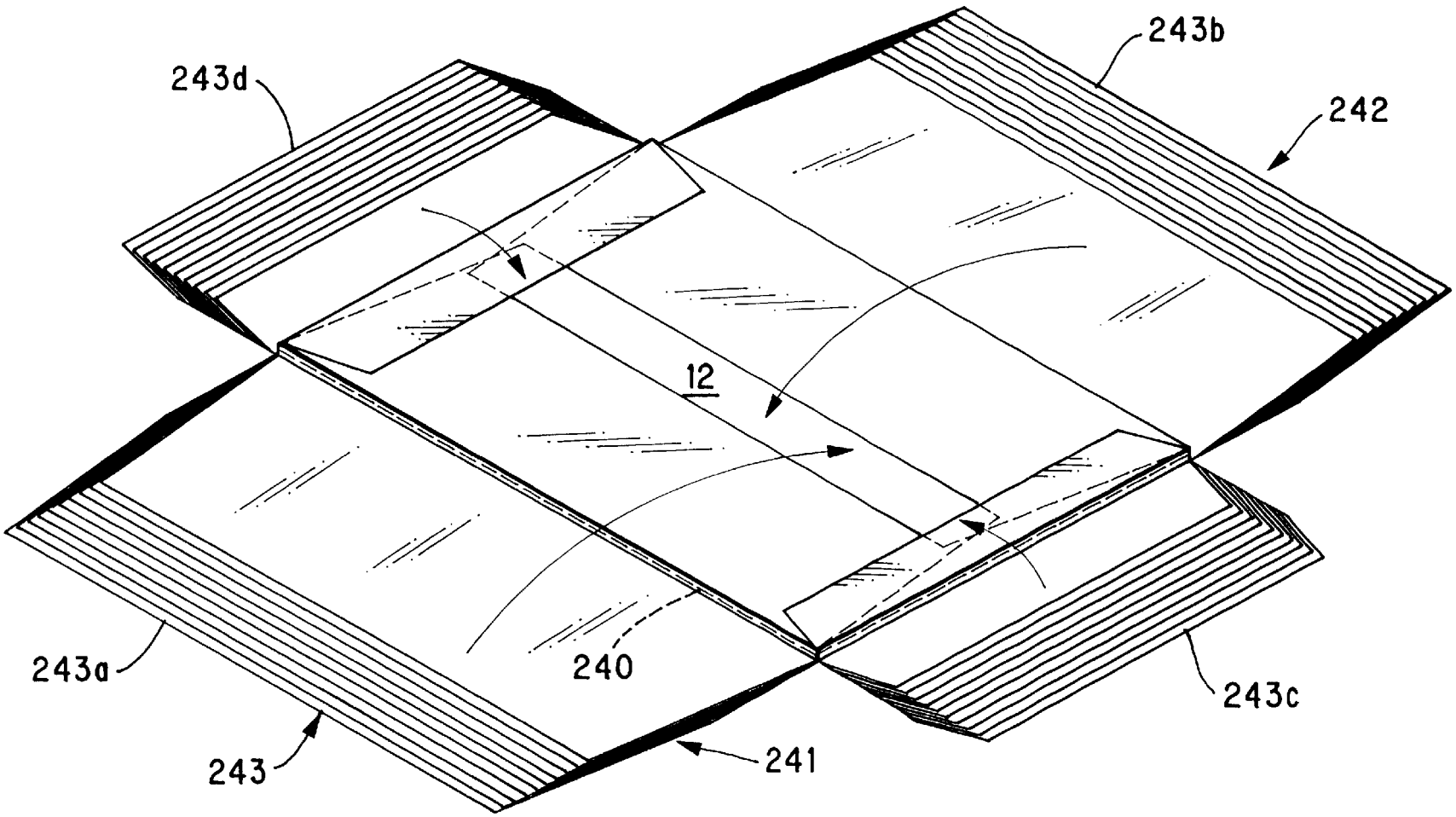
FIG. 29 is a perspective illustrating a spread state of a recording sheet package in which each recording sheet is wrapped in one of packaging sheets.

In FIG. 29, a recording sheet package 242 has a packaging material simply consisting of a bottom plate 240 and a multi-sheet 241. The bottom plate 240 has a size large enough to place the recording sheets 12 on it. The multi-sheet 241 is attached to the bottom surface of the bottom plate 240. The multi-sheet 241 consists of packaging sheets 243 of which the number is equal to the number of the recording sheets 12. The packaging sheets 243 are 5–15 $\mu$m thick, and has a moisture proof characteristic and a characteristic for shielding ultraviolet rays for optical fixation. The packaging sheets 243 include margin portions 243*a* and 243*b*and margin portions 243*c* and 243*d*. The margin portions 243*a* and 243*b* lie on longer side lines of the bottom plate 240. The margin portions 243*c* and 243*d* lie on shorter side lines of the bottom plate 240.

Figure 30:
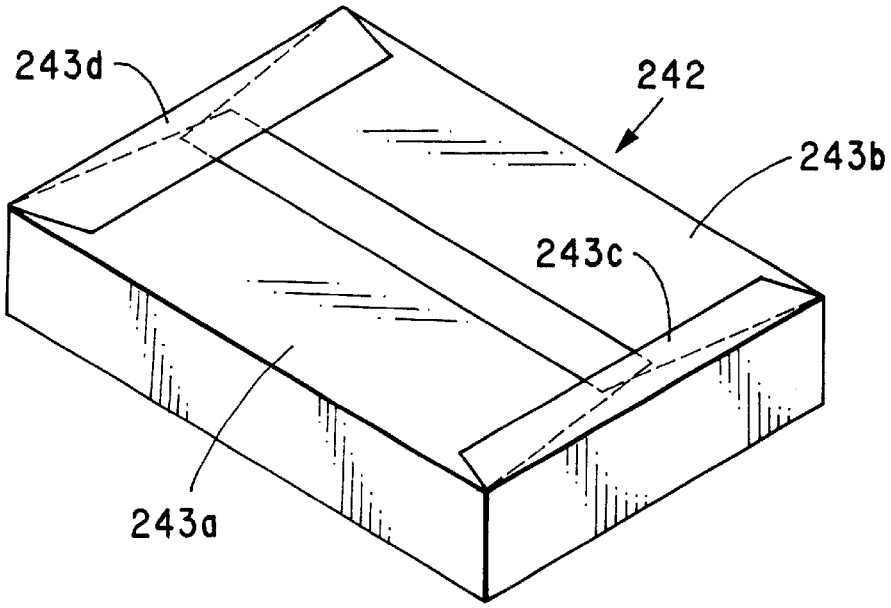
FIG. 30 is a perspective illustrating the recording sheet package.

To manufacture the recording sheet package 242, the lowest one of the recording sheets 12 is placed on the bottom plate 240 at first by directing its thermosensitive recording surface downwards. The margin portions 243*a* and 243*b* of the uppermost one of the packaging sheets 243 are bent and overlapped on the one of the recording sheets 12 to cover its lateral sides. Then the margin portions 243*c* and 243*d* of the uppermost one of the packaging sheets 243 are bent and overlapped on the margin portions 243*a* and 243*b*, before the second lowest one of the recording sheets 12 is placed on the margin portions 243*c* and 243*d* of the uppermost one of the packaging sheets 243. Similarly the remainder of the recording sheets 12 are placed, and the remainder of the margin portions 243*a*, 243*b*, 243*c* and 243*d* are bent to wrap the recording sheets 12. After the uppermost one of the recording sheets 12 is placed, the margin portions 243*a*–243*d* of the lowest one of the packaging sheets 243 are bent and overlapped on the one of the recording sheets 12 finally to obtain the recording sheet package 242 of FIG. 30. To use the recording sheets 12, the packaging sheets 243 are peeled one by one to take out each uppermost one of the recording sheets 12. Each of the recording sheets 12 can be manually inserted into a thermal printer.

In the present embodiment, each recording sheet is wrapped in one of the packaging sheets. Even when an uppermost one of the recording sheets is advanced, the remaining ones of the recording sheets are still wrapped, and can be protected from moisture and ambient light. Note that the bottom plate may be omitted from the packaging body. Also a top plate may be added to the bottom plate and the multisheet, to squeeze the wrapped recording sheets between the top plate and the bottom plate. Instead of the packaging sheets 243 having the margin portions 243*a*, 243*b*, 243*c* and 243*d*, rectangular packaging sheets may be used. Such rectangular packaging sheets can be bent along bend lines extending in parallel with side lines of the recording sheets to wrap them.

Figure 31:
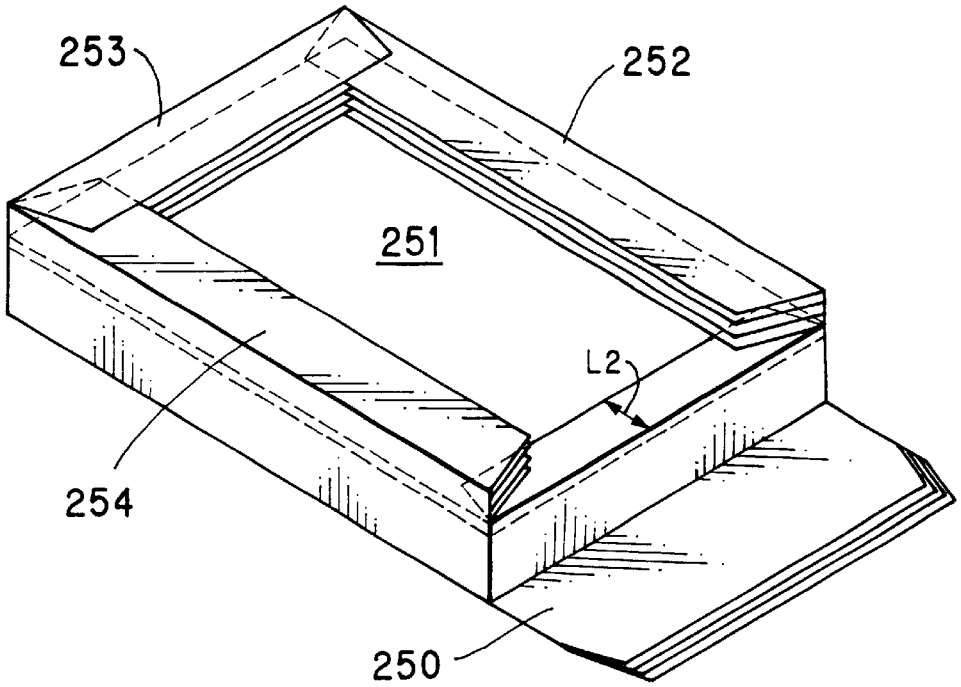
FIG. 31 is a perspective illustrating a recording sheet package in which a width of a margin portion bent on each of recording sheets is limited.

To supply the sheet automatically by setting the individually packaged type of the recording sheet package in the sheet supply cassette, a margin portion 250 is shaped as illustrated in FIG. 31. A width L2 of the margin portion 250 bent on each of thermosensitive recording sheets 251 is limited in a range of 1–20 mm, preferably 3–8 mm. Therefore the portion of the recording sheets 251 to be directly contacted by the supply roller is kept large. Resistance of pulling the recording sheets 251 is reduced. It is desirable that a width of margin portions 252, 253 and 254 bent on the recording sheets 251 should be similarly small. The lowest one of the packaging sheets (not shown) is formed in the same m manner that the lowest one of the packaging sheets 243 of FIG. 29 with the moisture proof and light-shielding characteristics, to wrap the entirety of the recording sheets 12. It is noted that the anti-dropping tapes 210 illustrated in FIG. 24 can be used instead of the margin portion 250 at the supply opening to lower the resistance in the supply of the recording sheets.

Furthermore the recording sheet packages of FIGS. 23–27 may be provided with the loading engaging cutouts 23–27 of FIG. 1, and also may have the bottom plate 11*b* and/or the push plate 11*h*.

In the above embodiments, the loading guiding projection 50 in the sheet supply cassette 40 is stationary. But a movable guide mechanism may be provided for setting the recording sheets in the supply position. In the above embodiments, the recording sheets 12 are thermosensitive. But a recording sheet package of the present invention can contain recording sheets of any types, including recording sheets for use with printing systems of the sublimation type, the wax-transfer type, the ink-jet type and the like.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A recording sheet package for a printer, comprising:

plural recording sheets;

a packaging body having a substantially thin box shape substantially rectangular parallelepiped, for containing a stack of said recording sheets;

a supply opening, formed in said packaging body, for exiting said recording sheets therethrough; and plural loading engaging portions, asymmetrically disposed on said packaging body, such that when said packaging body is set in a predetermined acceptable orientation relative to said printer, said loading engaging portions engage with loading guiding members, for allowing said packaging body to mount onto said printer, wherein when said packaging body is set in all orientations other than said acceptable orientation, one of said loading guiding members and said loading engaging portions inhibits said packaging body from being mounted onto said printer.

2. A recording sheet package as defined in claim 1, wherein said loading engaging portions comprise cutouts, formed in a periphery of said packaging body, for receiving insertion of said loading guiding members.

3. A recording sheet package as defined in claim 2, wherein said cutouts are formed in at least one of two side lines of said packaging body extending in a supply direction of said recording sheet.

4. A recording sheet package as defined in claim 2, wherein said cutouts are so formed as to make said periphery of said packaging body asymmetric with reference to a reference line passing a center of said packaging body and parallel with a supply direction of said recording sheets.

5. A recording sheet package as defined in claim 2, wherein said cutouts are so formed as to make said periphery of said packaging body asymmetric with reference to a reference line passing a center of said packaging body and perpendicular with a supply direction of said recording sheets.

6. A recording sheet package as defined in claim 1, wherein said cutouts are so formed as to make said periphery of said packaging body asymmetric with reference to a reference line passing a center of said packaging body and parallel with a supply direction of said recording sheets, and also to make said periphery of said packaging body asymmetric with reference to a reference line passing a center of said packaging body and perpendicular with a supply direction of said recording sheets.

7. A recording sheet package as defined in claim 1, further comprising a spacer, disposed in said packaging body and sideways from said recording sheets with reference to a supply direction of said recording sheets, for positioning said recording sheets sideways within said packaging body by defining a gap, wherein said loading engaging portion is constituted by said gap, and receives insertion of said loading guiding member.

8. A recording sheet package as defined in claim 1, wherein said printer includes:

a cassette loading port;

a sheet supply cassette mounted in said cassette loading port;

wherein said loading guiding members project from an inside of said sheet supply cassette; and said recording sheet package is mounted in said sheet supply cassette.

9. A recording sheet package as defined in claim 1, wherein said recording sheet package is mounted in a sheet loading port formed in said printer; and said loading guiding member projects from an inside of said sheet loading port.

10. A recording sheet package as defined in claim 1, wherein said packaging body includes a bottom plate and a top plate, opposed to each other, and adapted to contain said stack of said recording sheets, said bottom plate being movable at said supply opening toward said top plate.

11. A recording sheet package as defined in claim 1, wherein said packaging body includes an anti-dropping structure for preventing said recording sheets from dropping out of said supply opening.

12. A recording sheet supplying method for use with a combination of a recording sheet package and a printer, said recording sheet package including a packaging body shaped substantially in a rectangular parallelepiped, for containing a stack of recording sheets, said packaging body having a larger size than said recording sheets to form looseness therebetween, and a supply opening formed in said packaging body, for exiting said recording sheets therethrough, said recording sheet supplying method comprising the steps of:

forming plural cutouts in said packaging body in first and second side lines of said packaging body, said first and second side lines extending in a supply direction of said recording sheets, said cutouts being asymmetrically located such that (1) when said packaging body is set in a predetermined acceptable orientation relative to said printer, all of said cutouts engage with loading guiding members, for allowing said packaging body to mount onto said printer, and (2) when said packaging body is set in all orientations other than said acceptable orientation, one of said loading guiding members and said cutouts inhibit said packaging body from being mounted onto said printer; and loading said printer with said recording sheet package while inserting said loading guiding members in said cutouts, for positioning said recording sheets in said printer.

13. A recording sheet supplying method as defined in claim 12, wherein said printer includes:

a cassette loading port;

a sheet supply cassette, mounted in said cassette loading port, for receiving said recording sheet package;

wherein said loading guiding members project from an inside of said sheet supply cassette.

14. A recording sheet supplying method as defined in claim 12, wherein said recording sheets are set between said second side line of said packaging body and said loading guiding member inserted in said cutout, and positioned in a direction crosswise to said supply direction.

15. A recording sheet supplying method as defined in claim 12, wherein said cutouts include a first cutout in said first side line and a second cutout in said second side line of said packaging body, said loading guiding members comprise first and second loading guiding members inserted respectively in said first and second cutouts, and said recording sheets are set between said first and second loading guiding members and positioned in a direction crosswise to said supply direction.

16. A recording sheet supplying method as defined in claim 12, wherein said cutouts include a first cutout in said first side line and a second cutout in said second side line of said packaging body in an end opposite to said supply opening with reference to said supply direction of said recording sheets;

said recording sheet supplying method further comprising the step of:

inserting said second loading member in said second cutout, for positioning said recording sheets in said supply direction in said printer.

17. A recording sheet package for a printer, including plural recording sheets, and a packaging body, formed by bending one packaging sheet or plate, substantially having a thin box shape substantially of a rectangular parallelepiped, for containing a stack of said recording sheets, and a supply opening, formed in an end of said packaging body, for exiting said recording sheets therethrough, said recording sheet package comprising:

said packaging body including a bottom plate and a top plate, shaped substantially in a rectangular quadrilateral, opposed to each other, and adapted to contain said stack of said recording sheets, said bottom plate being movable at said supply opening toward said top plate.

18. A recording sheet package as defined in claim 17, wherein said recording sheets are thermosensitive recording sheets, and have a recording surface and a back surface reverse thereto, and said recording surface directed toward said bottom plate.

19. A recording sheet package as defined in claim 17, wherein said packaging body further includes a push plate, disposed on said top plate to extend from said supply opening, for contacting a top face of said recording sheets, to push said recording sheets toward said bottom plate.

20. A recording sheet package as defined in claim 17, wherein said printer includes:

a cassette loading port;

a sheet supply cassette mounted in said cassette loading port; and a lifter mechanism disposed in a bottom wall of said supply cassette;

said recording sheet package is mounted in said supply cassette, said bottom plate is pushed by said lifter mechanism so as to press said recording sheets against said top plate.

21. A recording sheet package as defined in claim 17, wherein each periphery of said bottom plate and said top plate has first to fourth bend lines, said supply opening is located on said first bend line, said first and second bend lines are opposed to each other, and said third and fourth bend lines are opposed to each other;

said packaging body further includes:

an end plate, disposed on said second bend line, for extending to connect said bottom plate and said top plate with each other; and first and second lateral plates, formed with said top plate, disposed on respective said third and fourth bend lines, for extending toward said bottom plate, said first and second lateral plates being free from said bottom plate at least partially, to set said bottom plate movable.

22. A recording sheet package as defined in claim 21, wherein said packaging body further includes:

first and second securing plates, disposed on respective bend lines of said first and second lateral plates opposite to said top plate, and partially overlapped outside said bottom plate; and an adhesive layer, applied partially to said first and second securing plates, for attaching said first and second securing plates to said bottom plate.

23. A recording sheet package as defined in claim 21, wherein said packaging body has a larger size than said recording sheets to form looseness therebetween;

further comprising at least one cutout, formed in a periphery of said packaging body, for receiving insertion of a loading guiding member, to position said recording sheets in said printer.

24. A recording sheet package as defined in claim 17, wherein said packaging body further includes an anti-dropping structure for preventing said recording sheets from dropping out of said supply opening.

25. A recording sheet package for a printer, including plural recording sheets, a packaging body, formed by bending one packaging sheet or plate, substantially having a thin box shape substantially of a rectangular parallelepiped, for containing a stack of said recording sheets, a supply opening, formed in an end of said packaging body, for exiting said recording sheets therethrough, said recording sheet package comprising:

said packaging body including:

a bottom plate and a top plate, shaped substantially in a rectangular quadrilateral, opposed to each other, and adapted to contain said stack of said recording sheets; and a push plate, disposed on said top plate to extend from said supply opening, for contacting a top face of said recording sheets, to push said recording sheets toward said bottom plate.

26. A recording sheet package for a printer, including plural recording sheets, a packaging body, formed by bending one packaging sheet or plate, substantially having a thin box shape substantially of a rectangular parallelepiped, for containing a stack of said recording sheets, a supply opening, formed in an end of said packaging body, for exiting said recording sheets therethrough, said recording sheet package comprising:

said packaging body including:

a bottom plate and a top plate, shaped substantially in a rectangular quadrilateral, opposed to each other, and adapted to contain said stack of said recording sheets and to define said supply opening therebetween, wherein each periphery of said bottom plate and said top plate has first to fourth bend lines, said supply opening is located on said first bend line, said first and second bend lines are opposed to each other, and said third and fourth bend lines are opposed to each other;

an end plate, disposed on said second bend line, for extending to connect said bottom plate and said top plate with each other; and first and second lateral plates, formed with said top plate, disposed on respective said third and fourth bend lines, for extending toward said bottom plate;

first and second securing plates, disposed on respective bend lines of said first and second lateral plates opposite to said top plate, and partially overlapped outside said bottom plate;

an adhesive layer, applied at least partially to said first and second securing plates, for attaching said first and second securing plates to said bottom plate; and a push plate, disposed on said top plate to extend from said supply opening, for contacting a top face of said recording sheets, to push said recording sheets toward said bottom plate.

* * * * *